US009974337B2

(12) United States Patent
Slurink et al.

(10) Patent No.: US 9,974,337 B2
(45) Date of Patent: May 22, 2018

(54) ELECTRONIC CIGARETTE

(71) Applicant: Sluis Cigar Machinery B.V., Kampen (NL)

(72) Inventors: Oscar Slurink, Heino (NL); Mark Leendert Meijer, Zwolle (NL)

(73) Assignee: Sluis Cigar Machinery B.V., Kampen (NL)

( * ) Notice: Subject to any disclaimer, the term of this patent is extended or adjusted under 35 U.S.C. 154(b) by 0 days. days.

(21) Appl. No.: 15/118,118

(22) PCT Filed: Feb. 13, 2015

(86) PCT No.: PCT/NL2015/050095
§ 371 (c)(1),
(2) Date: Aug. 11, 2016

(87) PCT Pub. No.: WO2015/122773
PCT Pub. Date: Aug. 20, 2015

(65) Prior Publication Data

US 2017/0035111 A1 Feb. 9, 2017

(30) Foreign Application Priority Data

Feb. 13, 2014 (NL) ..... 2012264

(51) Int. Cl.
*A24F 11/00* (2006.01)
*A24F 47/00* (2006.01)
*H05B 1/02* (2006.01)

(52) U.S. Cl.
CPC ..... *A24F 47/008* (2013.01); *H05B 1/0291* (2013.01); *H05B 1/0297* (2013.01)

(58) Field of Classification Search
CPC ..... A24F 47/008; A24B 15/167; H05B 3/18; H05B 3/30; H05B 3/0014; H05B 1/0244
USPC ..... 131/328, 329, 194
See application file for complete search history.

(56) References Cited

U.S. PATENT DOCUMENTS 5,498,855 A * 3/1996 Deevi ..... A24F 47/008 131/194
8,997,753 B2 * 4/2015 Li ..... H01C 17/00 128/202.21
2013/0056013 A1 3/2013 Terry et al.
(Continued)

FOREIGN PATENT DOCUMENTS

WO 2011/146174 A2 11/2011

*Primary Examiner* — Hien Vu
(74) *Attorney, Agent, or Firm* — Hoffmann & Baron, LLP

(57) ABSTRACT

An electronic cigarette includes a housing having a wall defining an inner space, and an inlet and an outlet providing access to the inner space, a vaporizer to produce a vapour and being located in the inner space of the housing, an electrical power device to provide electrical power to the vaporizer and being located in the inner space of the housing. The electrical power device includes a first electrical contact member being electrically connected to one of an anode and a cathode of the electrical power device, and a second electrical contact member being electrically connected to the other of the anode and the cathode of the electrical power device. The vaporizer includes a vaporizer outer surface, a third electrical contact member located on the vaporizer outer surface, and a fourth electrical contact member located on the vaporizer outer surface.

17 Claims, 22 Drawing Sheets

(56) References Cited

U.S. PATENT DOCUMENTS

| | | | | |
|---|---|---|---|---|
| 2013/0192615 | A1 | 8/2013 | Tucker et al. | |
| 2013/0199528 | A1* | 8/2013 | Goodman | F22B 1/282 128/203.26 |

* cited by examiner

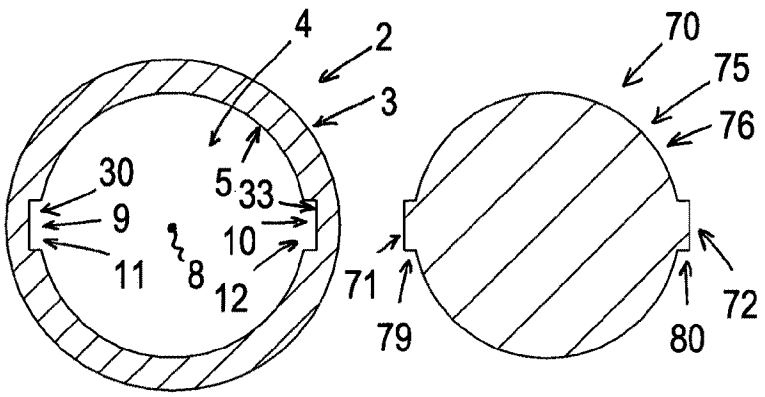
Fig. 14A
Fig. 14B
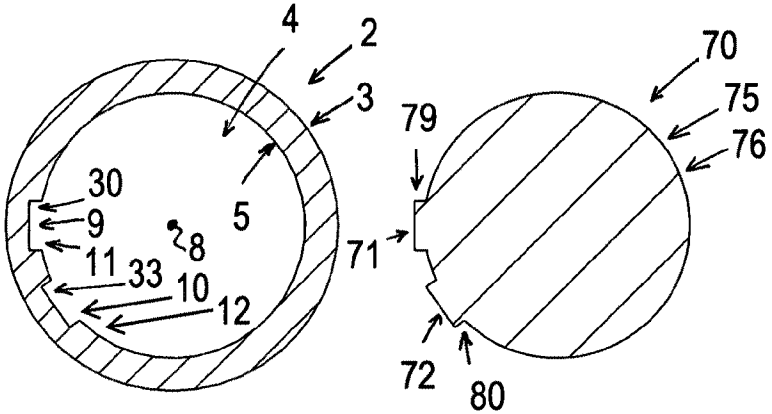
Fig. 15A
Fig. 15B
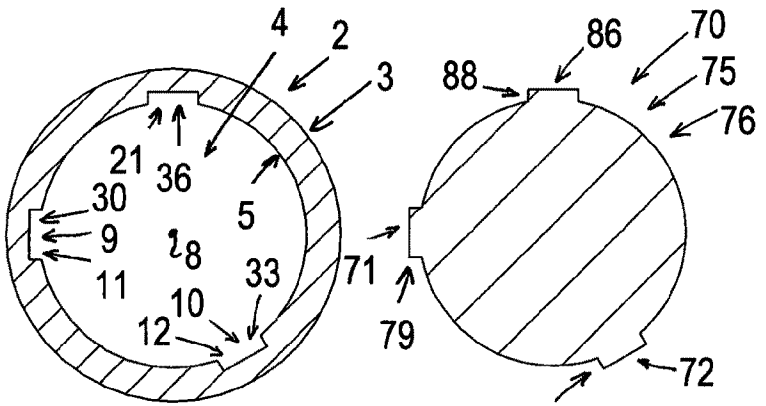
Fig. 16A
Fig. 16B
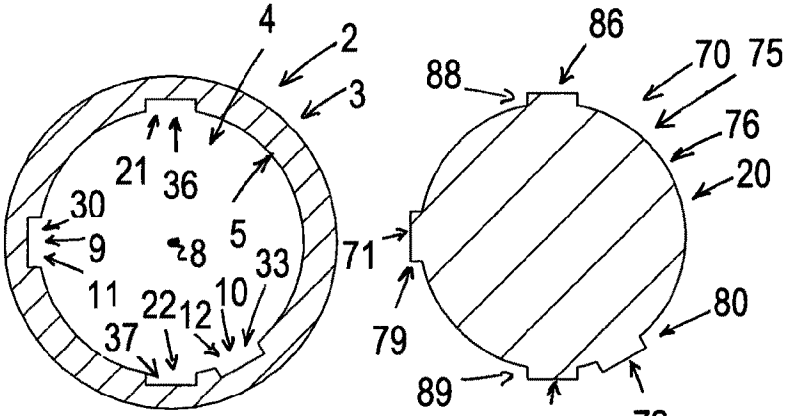
Fig. 17A
Fig. 17B

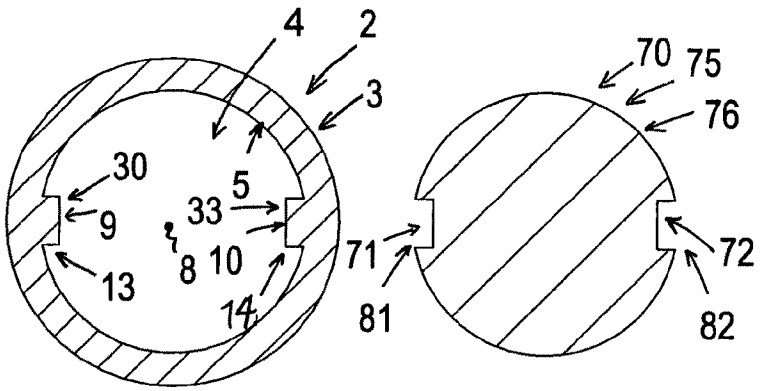
Fig. 18A
Fig. 18B
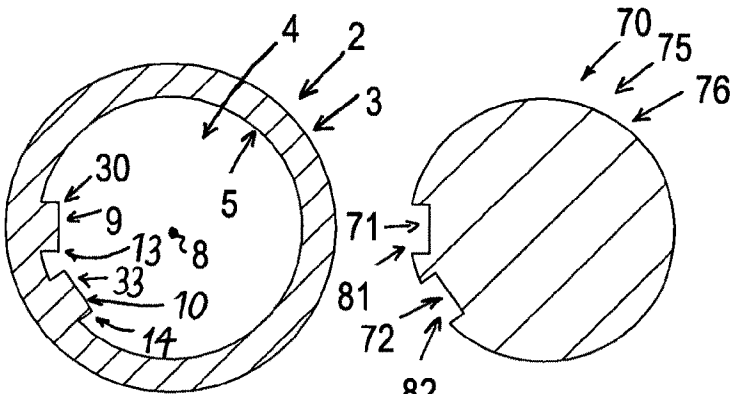
Fig. 19A
Fig. 19B
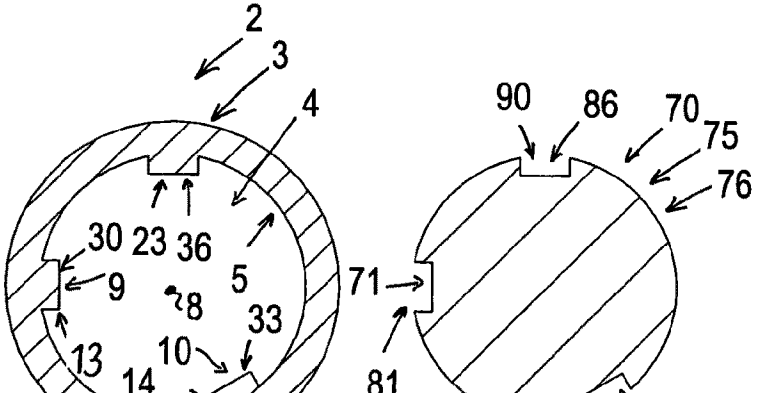
Fig. 20A
Fig. 20B
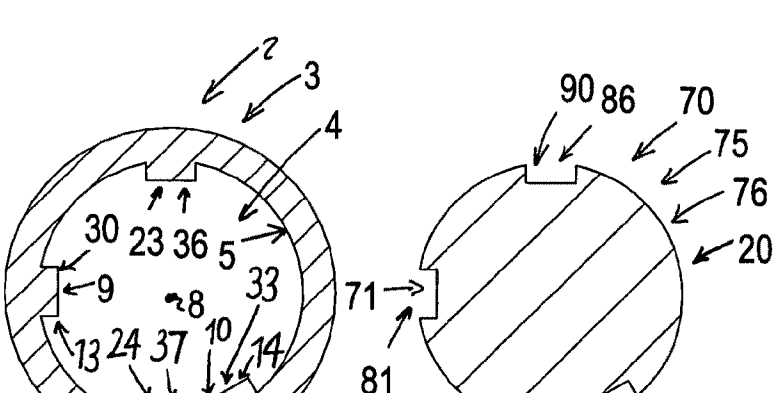
Fig. 21A
Fig. 21B

ELECTRONIC CIGARETTE

CROSS-REFERENCE TO RELATED APPLICATIONS

This application is the National Stage of International Application No. PCT/NL2015/050095 filed Feb. 13, 2015, which claims the benefit of Netherlands Application No. NL 2012264, filed Feb. 13, 2014, the contents of which is incorporated by reference herein.

FIELD OF THE INVENTION

The invention relates to an electronic cigarette for providing a vapour. The vapour can be inhaled by a person.

BACKGROUND OF THE INVENTION

The known electronic cigarette comprises a housing, a vaporizer, and an electrical power device. The vaporizer and the electrical power device are located in the housing. The electrical power device is attached to the vaporizer via electrical wires to provide electrical power so that the vapour can be produced.

A disadvantage of the known electronic cigarette is that it is difficult to produce, especially to produce it mechanically.

SUMMARY OF THE INVENTION

The invention has the objective to provide an improved, or at least alternative, electronic cigarette. According to one aspect according to the invention, the object is to provide an electronic cigarette which can be produced in a more simple manner. According to a further aspect according to the invention, the object is to provide an electronic cigarette which is can be produced mechanically.

The electronic cigarette according the invention comprises;

- a housing comprising a wall defining an inner space, and an inlet and an outlet providing access to the inner space,
- a vaporizer to produce the vapour and being located in the inner space of the housing,
- an electrical power device to provide electrical power to the vaporizer and being located in de inner space of the housing, wherein
  - the electrical power device comprises a device outer surface, a first electrical contact member located on the device outer surface and being electrically connected to one of an anode and a cathode of the electrical power device, and a second electrical contact member located on the device outer surface and being electrically connected to the other of the anode and the cathode of the electrical power device,
  - the vaporizer comprises a vaporizer outer surface, a third electrical contact member located on the vaporizer outer surface, and a fourth electrical contact member located on the vaporizer outer surface, and
  - the electronic cigarette comprises one, and only one, of the following features A, B, and C;

A) the first electrical contact member is positioned against and in contact with the third electrical contact member without being attached to the third electrical contact member, and the second electrical contact member is positioned against and in contact with the fourth electrical contact member without being attached to the fourth electrical contact member, B) the first electrical contact member and the third electrical contact member are both positioned against and in contact with a first conductor without being attached to the first conductor, and the second electrical contact member and the fourth electrical contact member are both positioned against and in contact with a second conductor without being attached to the second conductor, and C) the first electrical contact member and the third electrical contact member are both positioned against and in contact with a first conductor without being attached to the first conductor, and the second electrical contact member is positioned against and in contact with the fourth electrical contact member without being attached to the second electrical contact member.

Each of the features A, B and C allow that the electrical power device is electrically connected to the vaporizer without being attached to it (via for example electrical wires). The process to electrically attach the electrical power device to the vaporizer is difficult to perform, especially to perform it mechanically. The fact that in the electronic cigarette according to the invention the electrical power device and vaporizer are electrically connected without being attached to each other (directly or indirectly), leads to the result that the electronic cigarette can be produced in a more simple manner. This allows that the electronic cigarette according to the invention can be performed in a cost efficient manner by machines instead of by the hands of a person.

In an embodiment of the electronic cigarette according to the invention, the electrical power device and the vaporizer are dimensioned to be slided in the inner space of the housing.

In an embodiment of the electronic cigarette according to the invention,

- the device outer surface comprises a device side surface, a first device end surface, and an opposite second device end surface, and
- the vaporizer outer surface comprises a vaporizer side surface, a first vaporizer end surface, and an opposite second vaporizer end surface.

In an embodiment of the electronic cigarette according to the invention, the first device end surface and the first vaporizer end surface are facing the inlet and the second device end surface and the second vaporizer end surface are facing the outlet.

In an embodiment of the electronic cigarette according to the invention, the first device end surface and the first vaporizer end surface are facing the outlet and the second device end surface and the second vaporizer end surface are facing the inlet.

In an embodiment of the electronic cigarette according to the invention, the housing comprises a longitudinal housing axis.

In an embodiment of the electronic cigarette according to the invention, the electronic power device and the vaporizer can be slided into the housing in a direction of the longitudinal housing axis.

In an embodiment of the electronic cigarette according to the invention, the wall of the housing comprises an inner wall surface facing the inner space.

In an embodiment of the electronic cigarette according to the invention, the first conductor extends from the first electrical contact member to the third electrical contact member.

In an embodiment of the electronic cigarette according to the invention, the second conductor extends from the second electrical contact member to the fourth electrical contact member.

In an embodiment of the electronic cigarette according to the invention, the first electrical contact member is located on the first device end surface and the third electrical contact member is located on the second vaporizer end surface.

In an embodiment of the electronic cigarette according to the invention, the electronic cigarette has the feature B or C, and the first conductor is, in the direction of the longitudinal housing axis, located between the first device end surface and the second vaporizer end surface.

In an embodiment of the electronic cigarette according to the invention, the first conductor is formed by a first conductive unit which in the direction of the longitudinal housing axis is located between the electrical power device and the vaporizer and comprises a first conductive unit member being in contact with the first electrical contact member and the third electrical contact member.

In an embodiment of the electronic cigarette according to the invention, the second electrical contact member is located on the first device end surface and the fourth electrical contact member is located on the second vaporizer end surface.

In an embodiment of the electronic cigarette according to the invention, the electronic cigarette has the feature B, and the second conductor is, in the direction of the longitudinal housing axis, located between the first device end surface and the second vaporizer end surface.

In an embodiment of the electronic cigarette according to the invention, the second conductor is formed by a second conductive unit which in the direction of the longitudinal housing axis is located between the electrical power device and the vaporizer and comprises a second conductive unit member being in contact with the second electrical contact member and the third electrical contact member.

In an embodiment of the electronic cigarette according to the invention, the first conductive unit and second conductive unit are integrated in a single conductive unit.

In an embodiment of the electronic cigarette according to the invention, the electronic cigarette has the feature B or C, the first electrical contact member is located on the device side surface, the third electrical contact member is located on the vaporizer side surface, and the first conductor is formed by a first conductive wall member located on the inner wall surface of the housing and being in contact with the first electrical contact member and the third electrical contact member.

In an embodiment of the electronic cigarette according to the invention, the electronic cigarette has feature B, the second electrical contact member is located on the device side surface, the fourth electrical contact member is located on the vaporizer side surface, and the second conductor is formed by a second conductive wall member located on the inner wall surface of the housing being in contact with the second electrical contact member and the fourth electrical contact member.

In an embodiment of the electronic cigarette according to the invention, the electronic cigarette has feature B or C, the first conductive wall member is located on the inner wall surface, the device side surface comprises a first device protrusion, the first electrical contact member is located on the first device protrusion, the first device protrusion is positioned against the inner wall surface while the first electrical contact member is in contact with the first conductive wall member, the vaporizer side surface comprises a first vaporizer protrusion, the third electrical contact member is located on the first vaporizer protrusion, and the first vaporizer protrusion is positioned against the inner wall surface while the third electrical contact member is in contact with the first conductive wall member.

In an embodiment of the electronic cigarette according to the invention, the first conductive wall member fully surrounds the longitudinal housing axis.

In an embodiment of the electronic cigarette according to the invention, the inner wall surface comprises a first wall groove, the first conductive wall member is located in the first wall groove, the device side surface comprises a first device protrusion, the first electrical contact member is located on the first device protrusion, the first device protrusion is positioned in the first wall groove while the first electrical contact member is in contact with the first conductive wall member, the vaporizer side surface comprises a first vaporizer protrusion, the third electrical contact member is located on the first vaporizer protrusion, and the first vaporizer protrusion is positioned in the first wall groove while the third electrical contact member is in contact with the first conductive wall member.

In an embodiment of the electronic cigarette according to the invention, the inner wall surface comprises a second wall groove, the second conductive wall member is located in the second wall groove, the device side surface comprises a second device protrusion, the second electrical contact member is located on the second device protrusion, the second device protrusion is positioned in the second wall groove while the second electrical contact member is in contact with the second conductive wall member, the vaporizer side surface comprises a second vaporizer protrusion, the fourth electrical contact member is located on the second vaporizer protrusion, and the second vaporizer protrusion is positioned in the second wall groove while the fourth electrical contact member is in contact with the second conductive wall member.

In an embodiment of the electronic cigarette according to the invention, the inner wall surface comprises a first wall ridge, the first conductive wall member is located on the first wall ridge, the device side surface comprises a first device groove, the first electrical contact member is located in the first device groove, the first wall ridge is positioned in the first device groove while the first electrical contact member is in contact with the first conductive wall member, the vaporizer side surface comprises a first vaporizer groove, the third electrical contact member is located in the first vaporizer groove, and the first wall ridge is positioned in the first vaporizer groove while the third electrical contact member is in contact with the first conductive wall member.

In an embodiment of the electronic cigarette according to the invention, the inner wall surface comprises a second wall ridge, the second conductive wall member is locate on the second wall ridge, the device side surface comprises a second device groove, the second electrical contact member is located in the second device groove, the second wall ridge is positioned in the second device groove while the second electrical contact member is in contact with the second conductive wall member, the vaporizer side surface comprises a second vaporizer groove, the fourth electrical contact member is located in the second vaporizer groove, and the second wall ridge is positioned in the second vaporizer groove while the fourth electrical contact member is in contact with the second conductive wall member.

In an embodiment of the electronic cigarette according to the invention, the first conductive wall member and the second conductive wall member are located at a distance from each other.

In an embodiment of the electronic cigarette according to the invention, the first electrical contact member and the second electrical contact member of the electrical power device, and the third electrical contact member and fourth electrical contact member of the vaporizer form part of an electronic circuit of the electronic cigarette, and the electronic circuit also comprises a switch to open and close the electronic circuit.

In an embodiment of the electronic cigarette according to the invention, the switch is an automatic switch configured to detect an airflow and to close the electronic circuit when an airflow is detected and to open the electronic circuit when no airflow is detected.

In an embodiment of the electronic cigarette according to the invention, the electronic power device comprises a battery, the anode is formed by a negative terminal of the battery, and the cathode is formed by a positive terminal of the battery.

The invention further relates to a method for producing an electronic cigarette according to the invention, comprising one, and only one, of the following steps A, B, and C;

A) placing the electrical power device and the vaporizer in the inner space of the housing, such that the first electrical contact member is positioned against and in contact with the third electrical contact member without being attached to the third electrical contact member, and the second electrical contact member is positioned against and in contact with the fourth electrical contact member without being attached to the fourth electrical contact member, B) placing the electrical power device and the vaporizer in the inner space of the housing, such that the first electrical contact member and the third electrical contact member are both positioned against and in contact with a first conductor without being attached to the first conductor, the second electrical contact member and the fourth electrical contact member are both positioned against and in contact with a second conductor without being attached to the second conductor, and C) placing the electrical power device and the vaporizer in the inner space of the housing, such that the first electrical contact member and the third electrical contact member are both positioned against and in contact with a first conductor without being attached to the first conductor, and the second electrical contact member is positioned against and in contact with the fourth electrical contact member without being attached to the fourth electrical contact member.

The invention further relates to a method for producing an electronic cigarette comprising a housing, an electrical power device, and a vaporizer, which method comprises the steps of;

providing the housing comprising a wall which defines an inner space, and an inlet and an outlet providing access to the inner space, providing the electrical power device which comprises a device outer surface, a first electrical contact member located on the device outer surface and being electrically connected to one of an anode and a cathode of the electrical power device, and a second electrical contact member located on the device outer surface and being electrically connected to the other of the anode and the cathode of the electrical power device, providing the vaporizer which comprises a vaporizer outer surface, a third electrical contact member located on the vaporizer outer surface and a fourth electrical contact member located on the vaporizer outer surface, and the method comprises one, and only one, of the following steps A, B, and C;

A) placing the electrical power device and the vaporizer in the inner space of the housing, such that the first electrical contact member is positioned against and in contact with the third electrical contact member without being attached to the third electrical contact member, and the second electrical contact member is positioned against and in contact with the fourth electrical contact member without being attached to the fourth electrical contact member, B) placing the electrical power device and the vaporizer in the inner space of the housing, such that the first electrical contact member and the third electrical contact member are both positioned against and in contact with a first conductor without being attached to the first conductor, the second electrical contact member and the fourth electrical contact member are both positioned against and in contact with a second conductor without being attached to the second conductor, and C) placing the electrical power device and the vaporizer in the inner space of the housing, such that the first electrical contact member and the third electrical contact member are both positioned against and in contact with a first conductor without being attached to the first conductor, and the second electrical contact member is positioned against and in contact with the fourth electrical contact member without being attached to the fourth electrical contact member.

In an embodiment of the method according to the invention, the electrical power device and the vaporizer are slided into the inner space of the housing in the direction of the longitudinal housing axis.

In an embodiment of the method according to the invention, the placing of the electrical power device and the vaporizer in the inner space of the housing comprises sliding the electrical power device and the vaporizer into the inner space of the housing via the inlet or the outlet.

In an embodiment of the method according to the invention, the placing of the electrical power device and the vaporizer in the inner space of the housing comprises sliding the first electrical contact member and the third electrical contact member along the first conductive wall member.

In an embodiment of the method according to the invention, the placing of the electrical power device and the vaporizer in the inner space of the housing comprises sliding the second electrical contact member and the fourth electrical contact member along the second conductive wall member.

In an embodiment of the method according to the invention, the placing of the electrical power device and the vaporizer in the inner space of the housing comprises sliding the first device protrusion and the first vaporizer protrusion along the first conductive wall member.

In an embodiment of the method according to the invention, the placing of the electrical power device and the vaporizer in the inner space of the housing comprises sliding the first device protrusion and the first vaporizer protrusion through the first wall groove.

In an embodiment of the method according to the invention, the placing of the electrical power device and the vaporizer in the inner space of the housing comprises sliding the second device protrusion and the second vaporizer protrusion through the second wall groove.

In an embodiment of the method according to the invention, the placing of the electrical power device and the vaporizer in the inner space of the housing comprises sliding the first device groove and the first vaporizer groove along the first wall ridge.

In an embodiment of the method according to the invention, the placing of the electrical power device and the vaporizer in the inner space of the housing comprises sliding the second device groove and the second vaporizer groove along the second wall ridge.

The invention further relates to an electronic cigarette for providing a vapour, which electronic cigarette comprises;

- a housing comprising a wall defining an inner space, and an inlet and an outlet providing access to the inner space,
- a vaporizer to produce the vapour and being located in the inner space of the housing,
- an electrical power device to provide electrical power to the vaporizer and being located in de inner space of the housing, wherein
  - the electrical power device comprises a device outer surface, a first electrical contact member located on the device outer surface and being electrically connected to one of an anode and a cathode of the electrical power device, and a second electrical contact member located on the device outer surface and being electrically connected to the other of the anode and the cathode of the electrical power device,
  - the vaporizer comprises a vaporizer outer surface, a third electrical contact member located on the vaporizer outer surface, and a fourth electrical contact member located on the vaporizer outer surface,
  - the first electrical contact member is, directly or indirectly, electrically connected to the third electrical contact member without being attached to the third electrical contact member, and
  - the second electrical contact member is, directly or indirectly, electrically connected the fourth electrical contact member without being attached to the fourth electrical contact member.

In an embodiment of the electronic cigarette according to the invention, the electronic cigarette comprises one, and only one, of the features A, B and C described herein.

In an embodiment of the electronic cigarette according to the invention, the electronic cigarette comprises any one of the features described herein.

The invention further relates to a method for producing an electronic cigarette according to the invention, comprising placing the electrical power device and the vaporizer in the inner space of the housing, such that the first electrical contact member is, directly or indirectly, electrically connected to the third electrical contact member without being attached to the third electrical contact member, and the second electrical contact member is, directly or indirectly, electrically connected to the fourth electrical contact member without being attached to the fourth electrical contact member.

The invention further relates to a method for producing an electronic cigarette comprising a housing, an electrical power device, and a vaporizer, which method comprises the steps of;

- providing the housing comprising a wall which defines an inner space, and an inlet and an outlet providing access to the inner space,
- providing the electrical power device which comprises a device outer surface, a first electrical contact member located on the device outer surface and being electrically connected to one of an anode and a cathode of the electrical power device, and a second electrical contact member located on the device outer surface and being electrically connected to the other of the anode and the cathode of the electrical power device,
- providing the vaporizer which comprises a vaporizer outer surface, a third electrical contact member located on the vaporizer outer surface and a fourth electrical contact member located on the vaporizer outer surface, and
- the method comprises placing the electrical power device and the vaporizer in the inner space of the housing, such that the first electrical contact member is, directly or indirectly, electrically connected to the third electrical contact member without being attached to the third electrical contact member, and the second electrical contact member is, directly or indirectly, electrically connected to the fourth electrical contact member without being attached to the fourth electrical contact member.

In an embodiment of the method according to the invention, the method comprises one, and only one, of the steps A, B, and C described herein.

In an embodiment of the method according to the invention, the method comprises the any of the features described herein.

In an embodiment of the method according to the invention, the electrical power device and the vaporizer are slided into the inner space of the housing in the direction of the longitudinal housing axis.

BRIEF DESCRIPTION OF THE DRAWINGS

Embodiments of the electronic cigarette and the method to produce the electronic cigarette will be described by way of example only, with reference to the accompanying schematic drawings in which corresponding reference symbols indicate corresponding parts, and in which.

the FIGS. 1-10 schematically show a view in perspective of a first embodiment of the method according to the invention, FIG. 11 schematically shows a view in perspective of a first embodiment of the electronic cigarette according to the invention, the FIGS. 12 and 13 schematically show a view in perspective of the housing of the electronic cigarette of FIG. 1-11, the FIGS. 14-21 schematically show a view in cross section of the housing and the electrical power device of different embodiments of the electronic cigarette according to the invention, the FIGS. 22 and 23 schematically show a view in perspective of a second embodiment of the electronic cigarette and method according to the invention, the FIGS. 24 and 25 schematically show a view in perspective of a third embodiment of the electronic cigarette and method according to the invention, FIG. 26 schematically shows a view in perspective of a fourth embodiment of the electronic cigarette and method according to the invention, FIG. 27 schematically shows a view in perspective of a fifth embodiment of the electronic cigarette and method according to the invention.

DETAILED DESCRIPTION OF THE INVENTION

Figure 1:
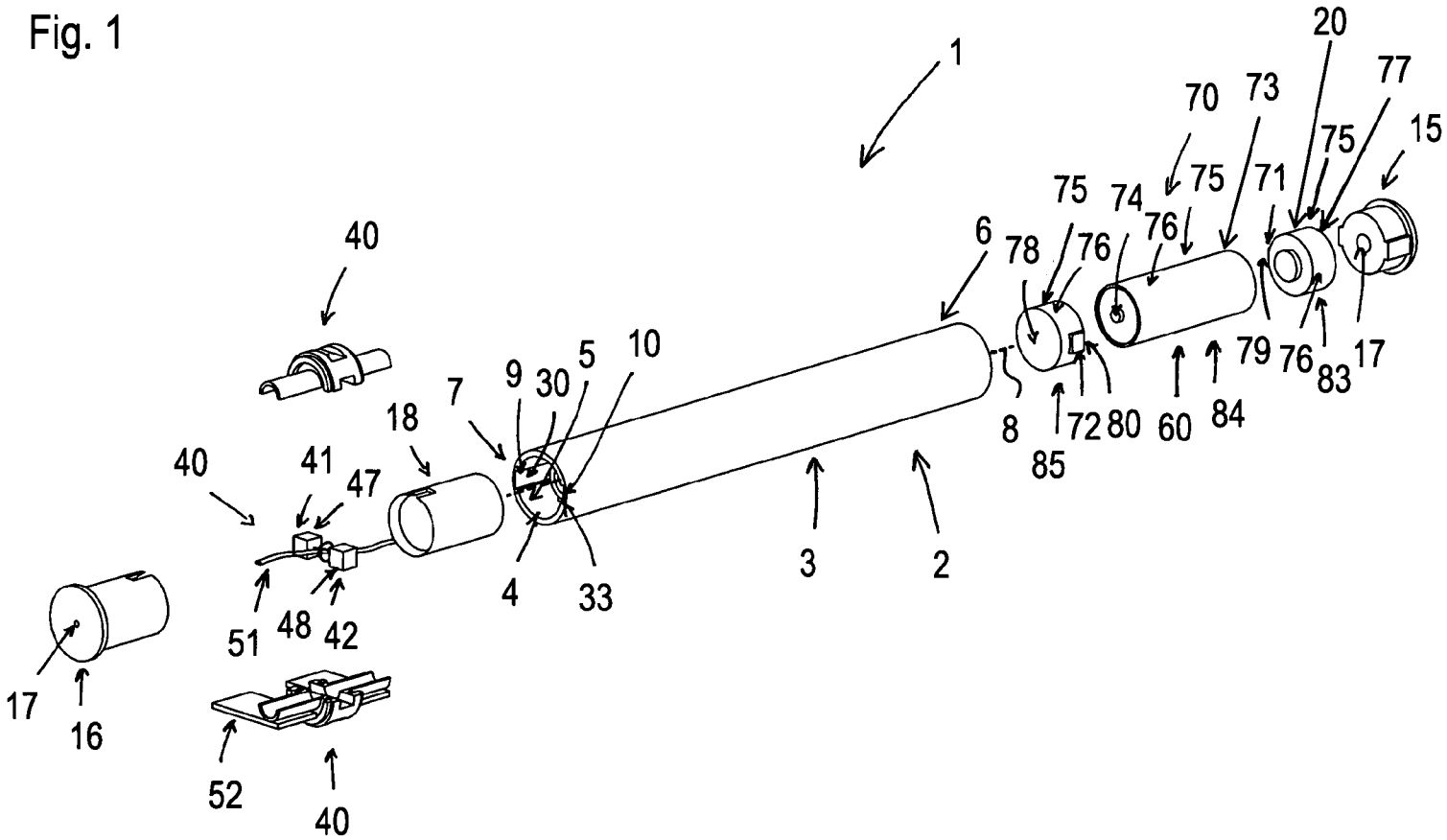
Figure 10:
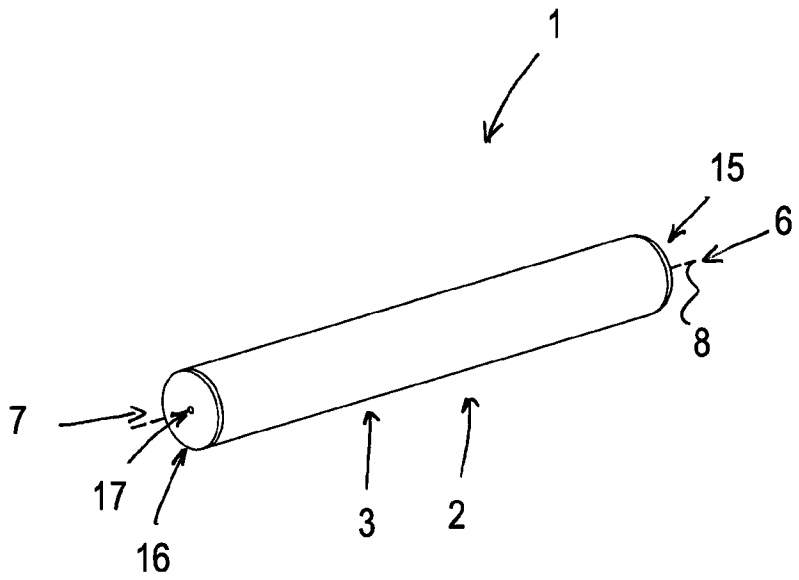
Figure 11:
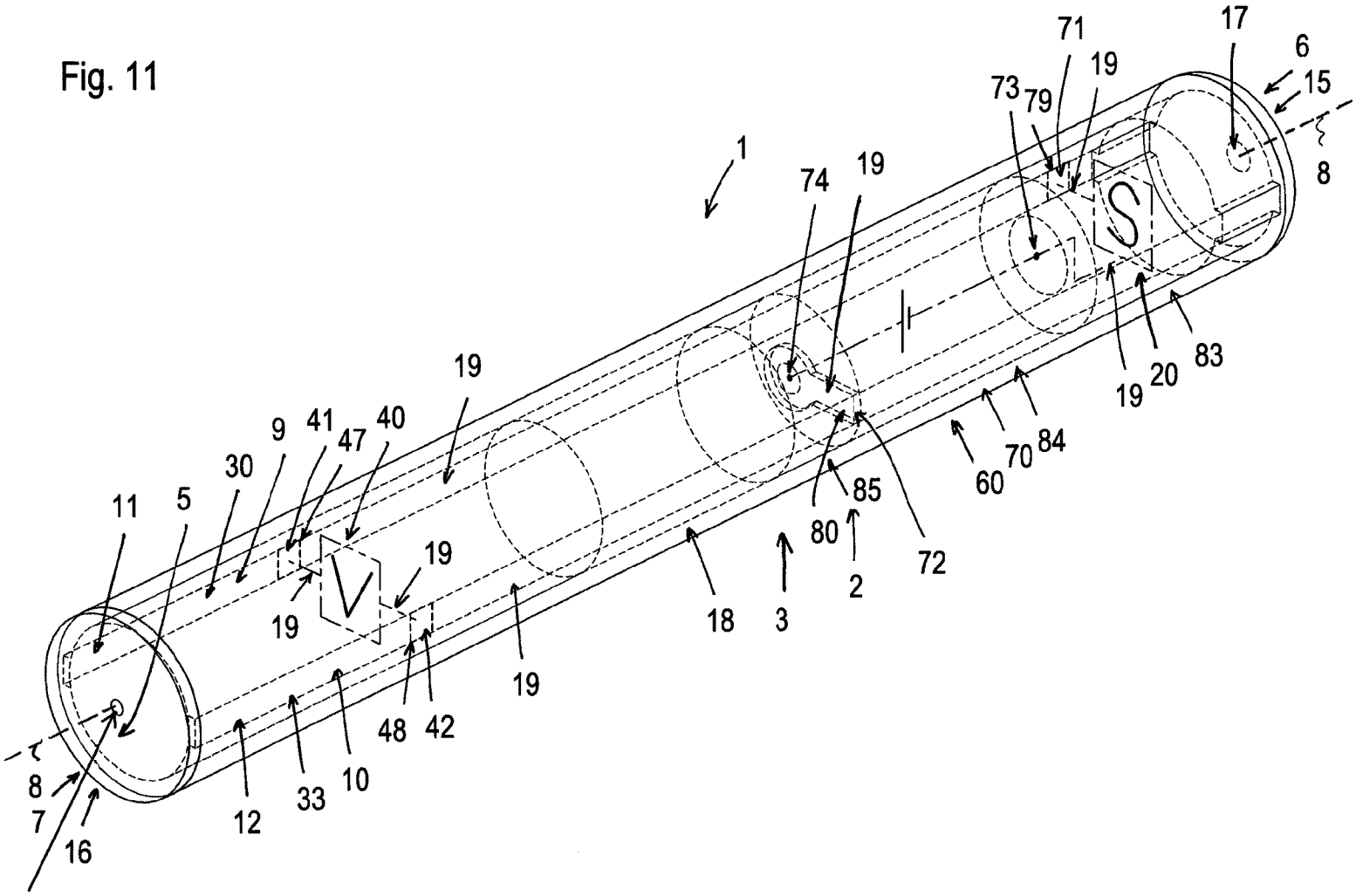

The FIG. 1-10 schematically show a first embodiment of the method according to the invention. FIG. 1 starts with an exploded view of a first embodiment of the electronic cigarette 1 according to the invention. The FIGS. 10 and 11 shown the end result of the method, namely a first embodiment of the electronic cigarette 1 according to the invention.

In the first embodiment of the method, a housing 2, a vaporizer 40, and an electrical power device 70 are provided. The housing 2 comprises a wall 3 defining an inner space 4. The wall 3 comprises an inner wall surface 5 facing the inner space 4. An inlet 6 and an outlet 7 provide access to the inner space 4.

The vaporizer 40 is configured to produce the vapour and is in use located in the inner space 4 of the housing 2. The electrical power device 70 is in use also located in de inner space 4 of the housing 2 and provides electrical power to the vaporizer 40. This way, an electronic circuit 19 of the electronic cigarette 1 is formed.

An automatic switch 20 is also provided. The automatic switch 20 is in use located in the inner space 4 of the housing 2 and connected to the electronic circuit 19 of the electronic cigarette 1. The automatic switch 20 is configured to detect an airflow along the automatic switch 20 and to close the electronic circuit 19 when an airflow is detected and to open the electronic circuit 19 when no airflow is detected. The automatic switch 20 is a mechanical switch 20. In other embodiments of the electronic cigarette 1, an electronic switch 20 is used.

A first cap 15 and a second cap 16 are provided. The first cap 15 is placed in the inlet 6 and the second cap 16 in the outlet 7. Each of the first cap 15 and second cap 16 comprises an air opening 17 to allow an airflow through the electronic cigarette 1. This airflow is created when a user sucks on the outlet 7 of the electronic cigarette 1. The airflow causes that the switch 20 closes the electronic circuit 19. As a result of this, the vaporizer 40 produces vapour. The vapour is transported by the airflow out of the outlet 7. The user can subsequently inhale the vapour. The vapour can comprises one or more of; nicotine, a flavouring substance, and a colouring substance. Instead or in addition thereto, the vapour can comprise one or more other substances.

In another embodiment of the electronic cigarette 1 according to the invention, a manual switch is provided instead of an automatic switch 20. In said situation, the user needs to activate the manual switch in order to ensure that vapour is produced by the vaporizer 40. It is of course also possible that the electronic cigarette 1 does not have a switch. In said situation, the vaporizer 40 will continuously produce vapour.

An intermediate unit 18 is provided. The intermediate unit 18 is in use located in the inner space 4 and positioned between the vaporizer 40 and the electrical power device 70.

The electrical power device 70 is formed by a first device unit 83, a second device unit 84 and a third device unit 85. The electrical power device 70 comprises a device outer surface 75, a first electrical contact member 71 located on the device outer surface 75 and in use being electrically connected to an anode 73 of the electrical power device 70, and a second electrical contact member 72 located on the device outer surface 75 and in use being electrically connected to an cathode 74 of the electrical power device 70. The second device unit 84 comprises a battery 60. The anode 73 is formed by the negative terminal of the battery 60 and the cathode 74 by the positive terminal of the battery 60.

In another embodiment of the electronic cigarette 1 according to the invention, the first electrical contact member 71 is electrically connected to the cathode 74 of the electrical power device 70, and the second electrical contact member 72 is electrically connected to the anode 73 of the electrical power device 70.

The automatic switch 20 is integrated in the first device unit 83. It is of course possible that the automatic switch 20 is located at a different location in the electronic circuit 19, such as being integrated in the vaporizer 40 or the second device unit 84.

The vaporizer 40 comprises a heating element 51 which in use provides heat to vaporise a liquid held by a liquid holding member 52. The vaporizer comprises a vaporizer outer surface 43, a third electrical contact member 41 located on the vaporizer outer surface 43, and a fourth electrical contact member 42 located on the vaporizer outer surface 43.

The method for producing the electronic cigarette 1 comprises the following step B; placing the electrical power device 70 and the vaporizer 40 in the inner space 4 of the housing 2, such that the first electrical contact member 71 and the third electrical contact member 41 are both positioned against and in contact with a first conductor 30 without being attached to the first conductor 30, the second electrical contact member 72 and the fourth electrical contact member 42 are both positioned against and in contact with a second conductor 33 without being attached to the second conductor 33.

In an alternative embodiment of the method according to the invention, the method comprises (instead of the step B) the following step A; placing the electrical power device 70 and the vaporizer 40 in the inner space 4 of the housing 2, such that the first electrical contact member 71 is positioned against and in contact with the third electrical contact member 41 without being attached to the third electrical contact member 41, and the second electrical contact member 72 is positioned against and in contact with the fourth electrical contact member 42 without being attached to the fourth electrical contact member 42. This is amongst others shown in the FIGS. 24 and 25.

In another alternative embodiment of the method according to the invention, the method comprises (instead of the step A or B) the following step C; placing the electrical power device 70 and the vaporizer 40 in the inner space 4 of the housing 2, such that the first electrical contact member 71 and the third electrical contact member 41 are both positioned against and in contact with a first conductor 30 without being attached to the first conductor 30, and the second electrical contact member 72 is positioned against and in contact with the fourth electrical contact member 42 without being attached to the fourth electrical contact member 42. This is amongst others shown in the FIGS. 22 and 23.

Each of the steps A, B and C allow that the electrical power device 70 is electrically connected to the vaporizer 40 without being attached to it (via for example electrical wires). The process to electrically attach the electrical power device 70 to the vaporizer 40 is difficult to perform, especially to perform this mechanically. The fact that in the method according to the invention the electrical power device 70 and vaporizer 40 are electrically connected without being attached to each other (directly or indirectly), leads to the result that the electronic cigarette 1 can be produced in a more simple manner. This allows that that the method for producing the electronic cigarette 1 according to the invention can be performed in a cost efficient manner by machines instead of by the hands of a person.

Each of the steps A, B and C can also be defined as that the method comprises placing the electrical power device 70 and the vaporizer 40 in the inner space 4 of the housing, such that the first electrical contact member 71 is, directly or indirectly, electrically connected to the third electrical contact member 41 without being attached to the third electrical contact member 41, and the second electrical contact member 72 is, directly or indirectly, electrically connected to the fourth electrical contact member 42 without being attached to the fourth electrical contact member 42.

Figure 2:
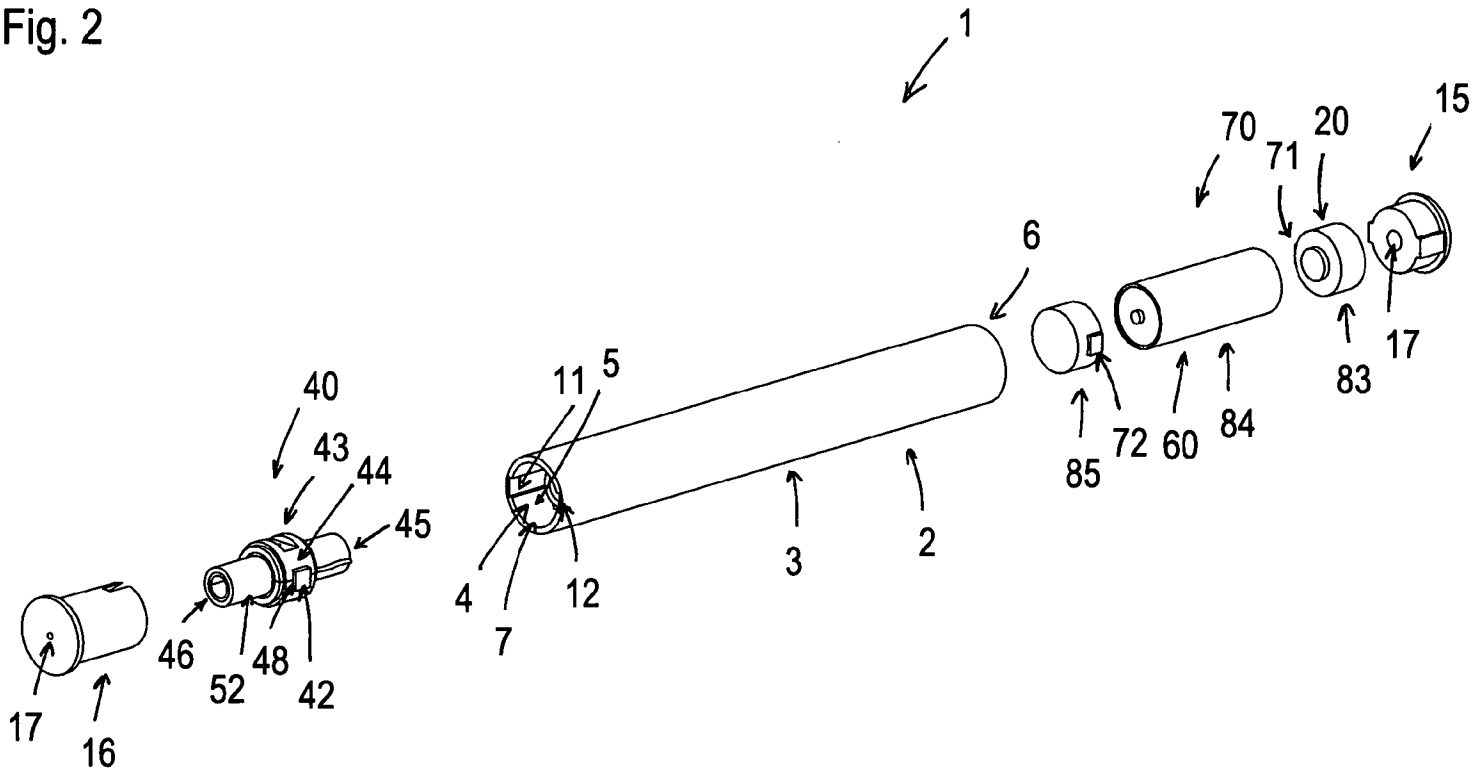
Figure 3:
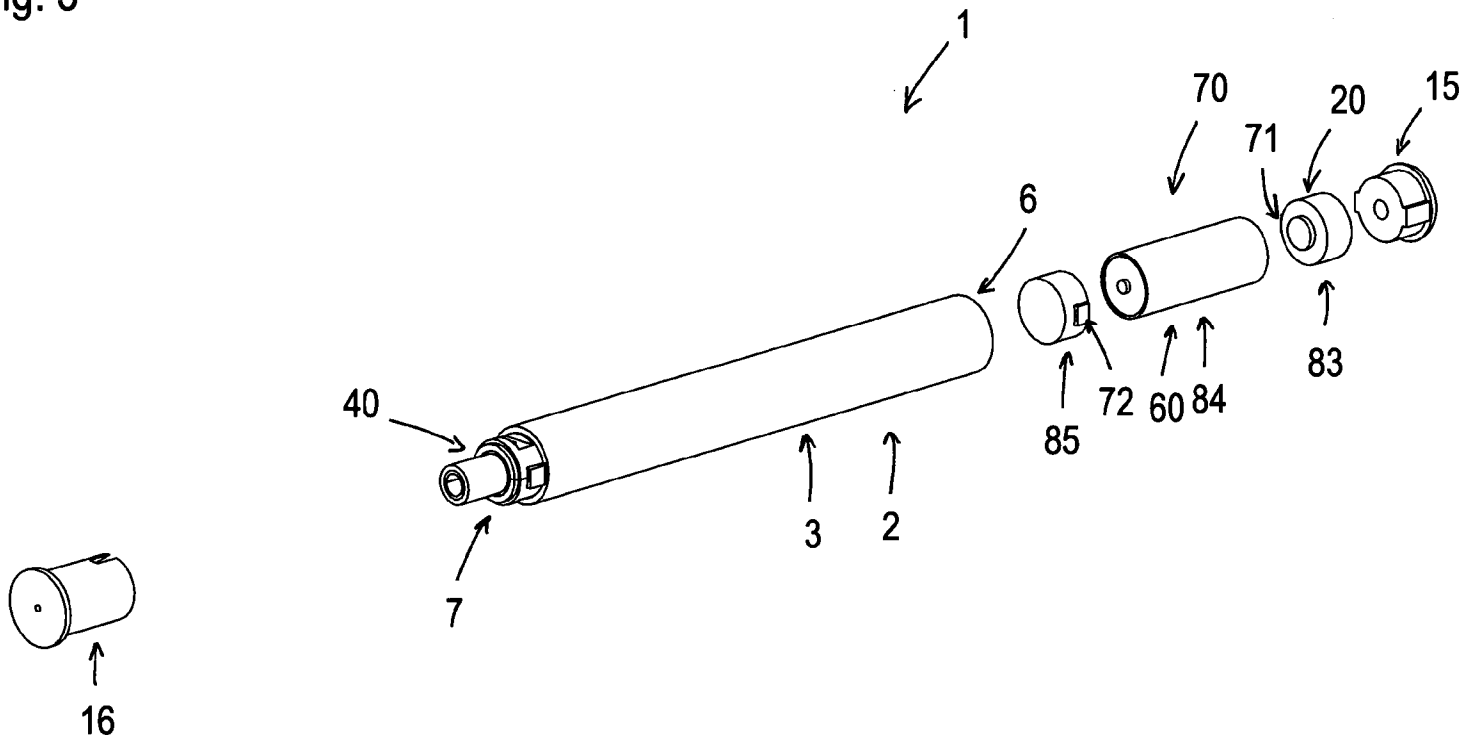
Figure 4:
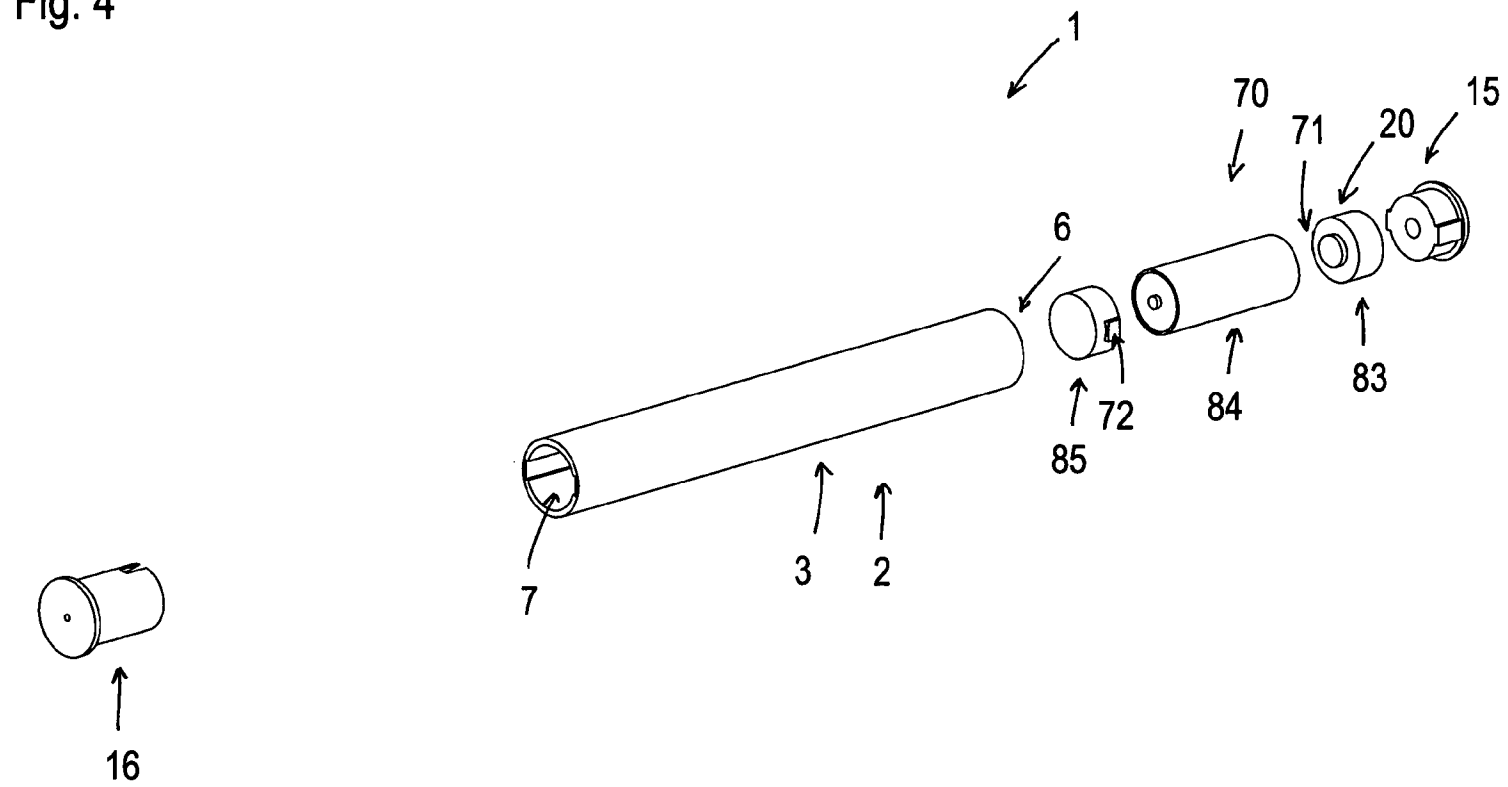
Figure 5:
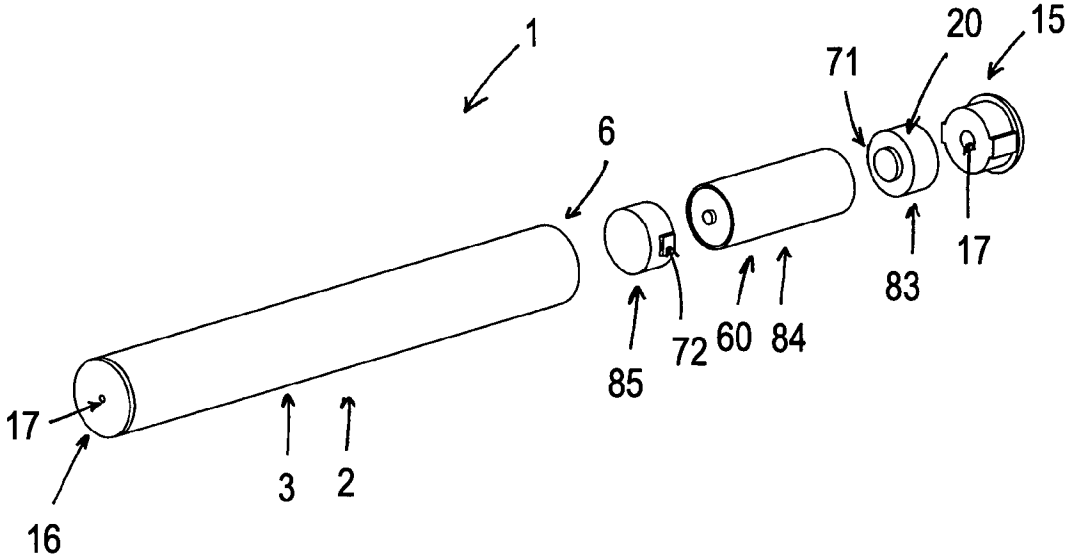
Figure 6:
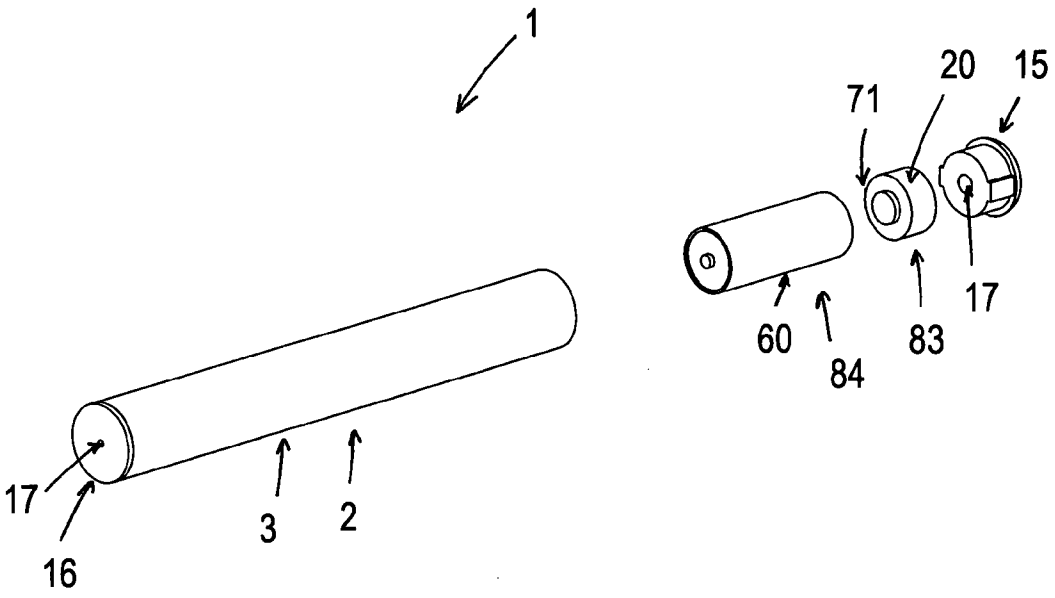
Figure 7:
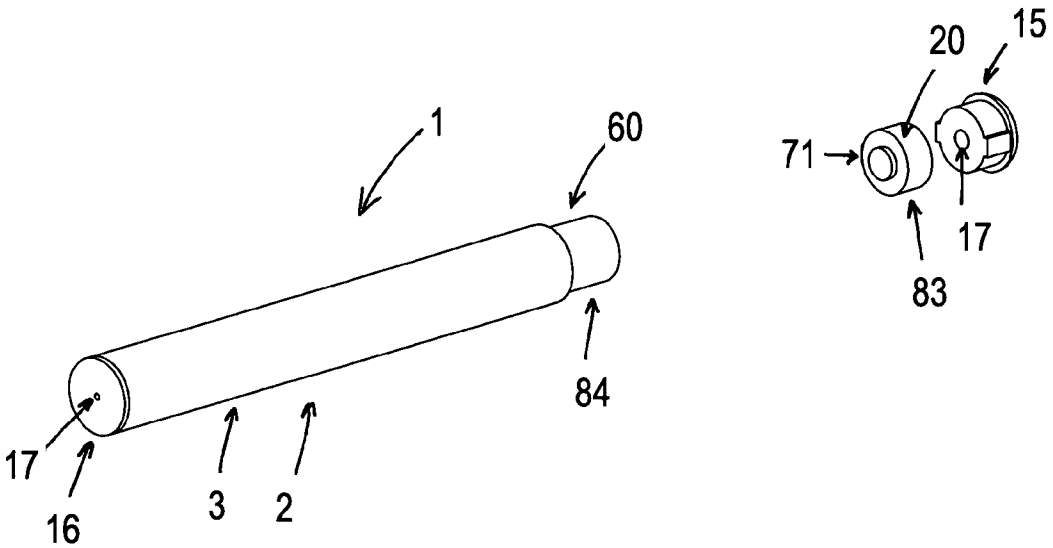
Figure 8:
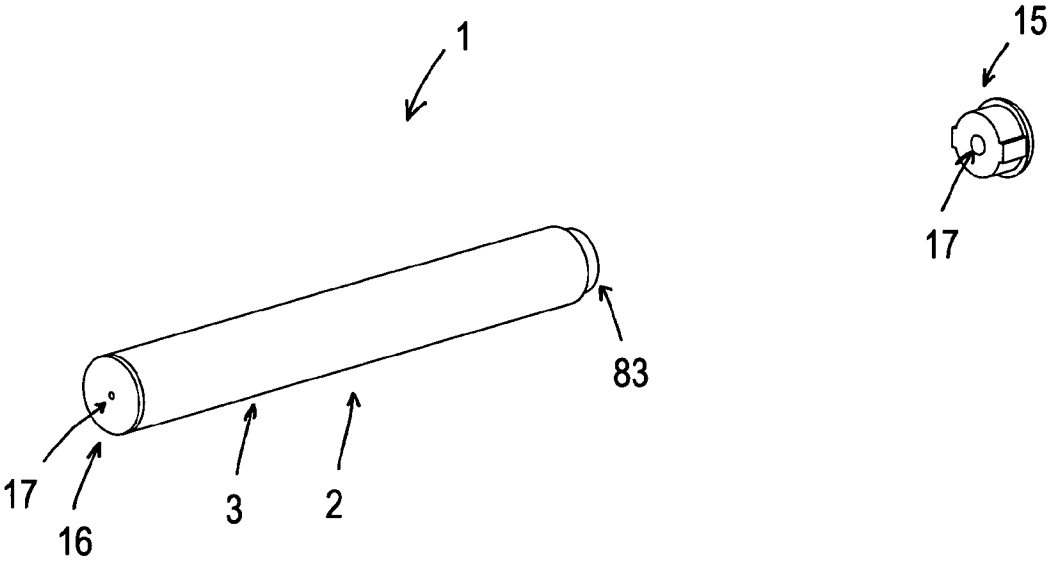
Figure 9:
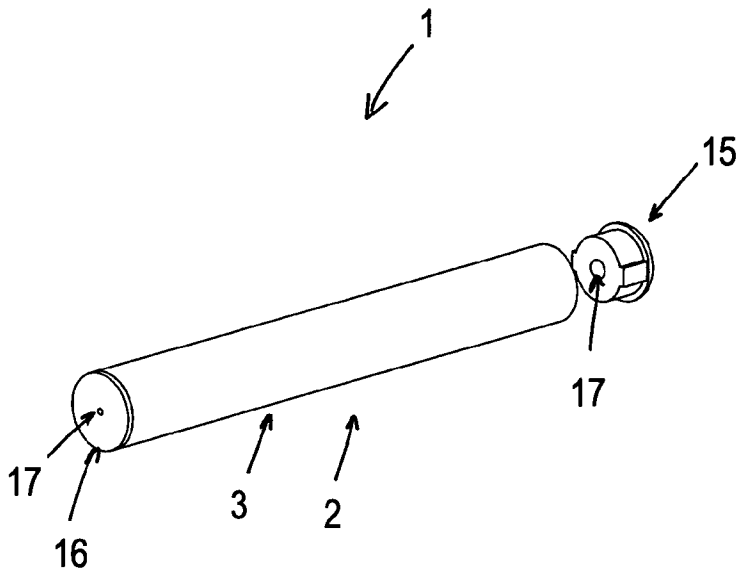

FIG. 1 shows an exploded view of the electronic cigarette 1. In FIG. 2, the intermediate member unit 18 is placed in the inner space 4 of the housing 2 and the vaporizer 40 is assembled. In the FIGS. 3 and 4, the vaporizer 40 is placed in the inner space 4 of the housing 2. In FIG. 5, the second cap 16 is placed in the outlet 7 of the housing 2. In FIG. 6, the third device unit 85 of the electrical power device 70 is placed in the inner space 4 of the housing 2. In FIG. 7, the second device unit 84 of the electrical power device 70 is placed in the inner space 4 of the housing 2. In FIG. 8, the first device unit 83 of the electrical power device 70 is placed in the inner space 4 of the housing 2. In the FIGS. 9 and 10, the first cap 15 is placed in the inlet 6 of the housing 2.

The FIGS. 10 and 11 shown the end result of the method of the FIGS. 1-10, namely the first embodiment of the electronic cigarette 1 according to the invention. As can be seen in FIG. 11, the electronic cigarette 1 comprises the feature B; wherein the first electrical contact member 71 and the third electrical contact member 41 are both positioned against and in contact with a first conductor 30 without being attached to the first conductor 30, and the second electrical contact member 72 and the fourth electrical contact member 42 are both positioned against and in contact with a second conductor 33 without being attached to the second conductor 33.

In an alternative embodiment of the electronic cigarette 1 according to the invention, the electronic cigarette 1 comprises (instead of feature B) the feature A; wherein the first electrical contact member 71 is positioned against and in contact with the third electrical contact member 41 without being attached to the third electrical contact member 41, and the second electrical contact member 72 is positioned against and in contact with the fourth electrical contact member 42 without being attached to the fourth electrical contact member 42. This is amongst others shown in the FIGS. 24 and 25.

In another alternative embodiment of the electronic circuit 19 according to the invention, the electronic cigarette 1 comprises (instead of feature A or B) the feature C; wherein the first electrical contact member 71 and the third electrical contact member 41 are both positioned against and in contact with a first conductor 30 without being attached to the first conductor 30, and the second electrical contact member 72 is positioned against and in contact with the fourth electrical contact member 42 without being attached to the fourth electrical contact member 42. This is amongst others shown in the FIGS. 22 and 23.

Each of the features A, B and C can also be defined as that the first electrical contact member 71 is, directly or indirectly, electrically connected to the third electrical contact member 41 without being attached to the third electrical contact member 41, and the second electrical contact member 72 is, directly or indirectly, electrically connected to the fourth electrical contact member 42 without being attached to the fourth electrical contact member 42.

Figure 12:
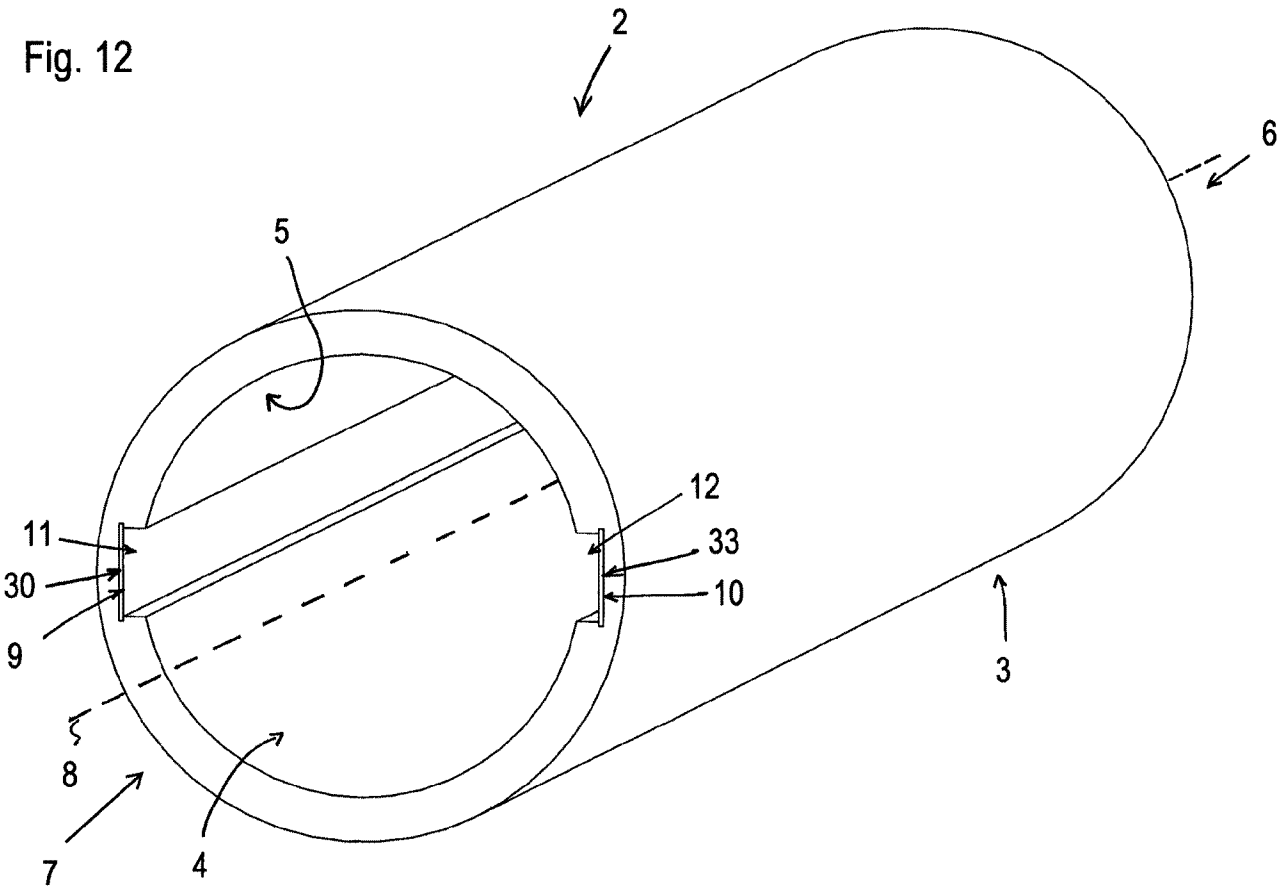
Figure 13:
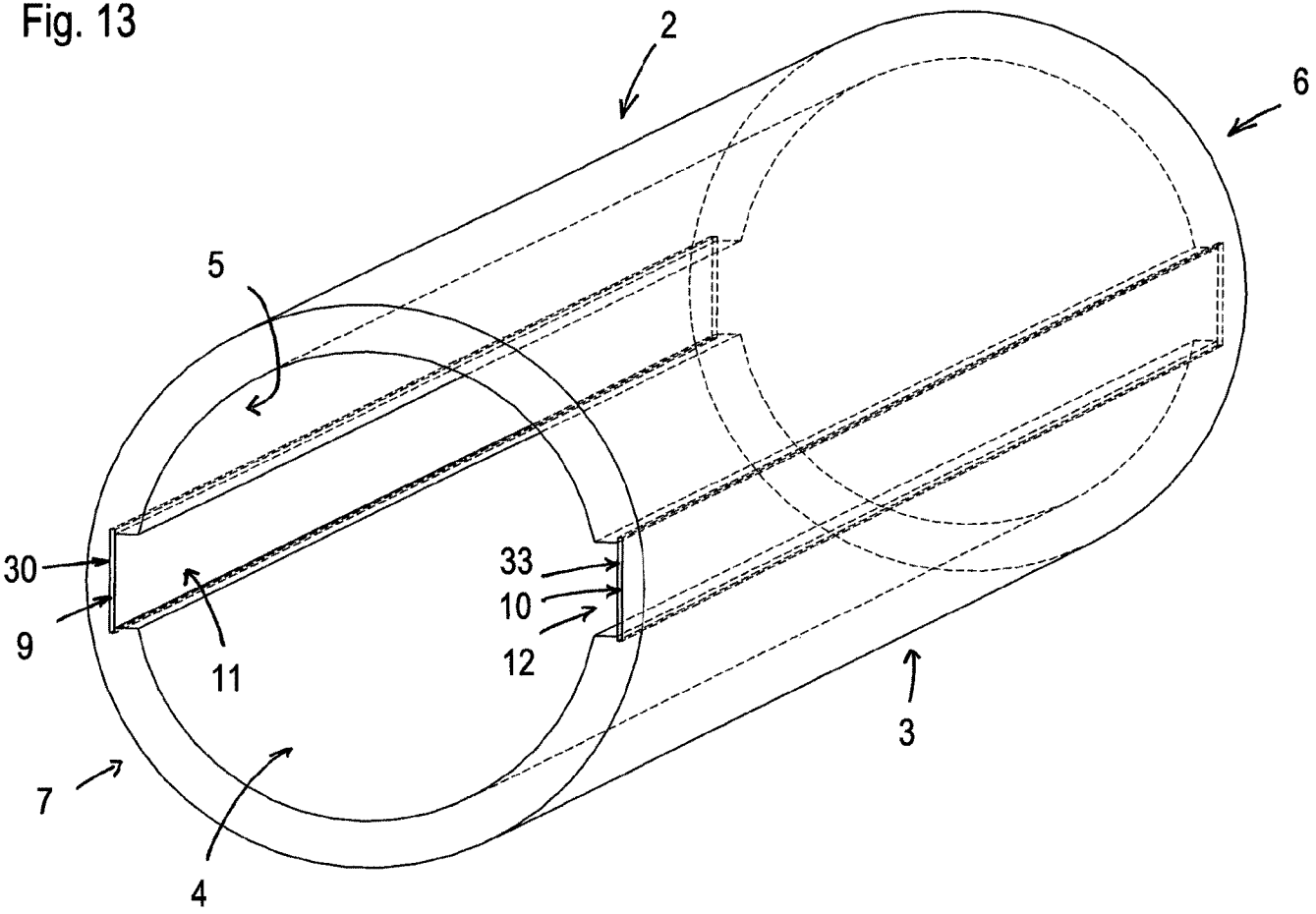

The FIGS. 12 and 13 show the housing 2 of the electronic cigarette 1 of FIG. 11. The housing 2 comprises a longitudinal housing axis 8. FIGS. 14 A and B show a view in cross section of the housing 2 and the vaporizer 40 perpendicular to the longitudinal housing axis 8. The wall 3 of the housing 2 comprises an inner wall surface 5 facing the inner space 4.

As can be seen from the FIGS. 1-11, the electrical power device 70 and the vaporizer 40 are dimensioned to be slided in the inner space 4 of the housing 2.

The device outer surface 75 comprises a device side surface 76, a first device end surface 77, and an opposite second device end surface 78. The vaporizer outer surface 43 comprises a vaporizer side surface 44, a first vaporizer end surface 45, and an opposite second vaporizer end surface 46.

The first device end surface 77 and the first vaporizer end surface 45 are facing the inlet 6 and the second device end surface 78 and the second vaporizer end surface 46 are facing the outlet 7. In an alternative embodiment of the electronic cigarette 1, the first device end surface 77 and the first vaporizer end surface 45 are facing the outlet 7 and the second device end surface 78 and the second vaporizer end surface 46 are facing the inlet 6.

The first conductor 30 extends from the first electrical contact member 71 to the third electrical contact member 41 and the second conductor 33 extends from the second electrical contact member 72 to the fourth electrical contact member 42.

The first electrical contact member 71 is located on the device side surface 76, the third electrical contact member 41 is located on the vaporizer side surface 44, and the first conductor 30 is formed by a first conductive wall member 9 located on the inner wall surface 5 of the housing 2 and being in contact with the first electrical contact member 71 and the third electrical contact member 41.

The second electrical contact member 72 is located on the device side surface 76, the fourth electrical contact member 42 is located on the vaporizer side surface 44, and the second conductor 33 is formed by a second conductive wall member 10 located on the inner wall surface 5 of the housing 2 being in contact with the second electrical contact member 72 and the fourth electrical contact member 42.

The method of the FIGS. 1-10 comprises placing the electrical power device 70 and the vaporizer 40 in the inner space 4 of the housing 2 by sliding the first electrical contact member 71 and the third electrical contact member 41 along the first conductive wall member 9 and by sliding the second electrical contact member 72 and the fourth electrical contact member 42 along the second conductive wall member 10.

The inner wall surface 5 comprises a first wall groove 11. The first conductive wall member 9 is located in the first wall groove 11. The device side surface 76 comprises a first device protrusion 79. The first electrical contact member 71 is located on the first device protrusion 79. The first device protrusion 79 is positioned in the first wall groove 11 while the first electrical contact member 71 is in contact with the first conductive wall member 9. The vaporizer side surface 44 comprises a first vaporizer protrusion 47. The third electrical contact member 41 is located on the first vaporizer protrusion 47. The first vaporizer protrusion 47 is positioned in the first wall groove 11 while the third electrical contact member 41 is in contact with the first conductive wall member 9.

The inner wall surface 5 comprises a second wall groove 12. The second conductive wall member 10 is located in the second wall groove 12. The device side surface 76 comprises a second device protrusion 80. The second electrical contact member 72 is located on the second device protrusion 80. The second device protrusion 80 is positioned in the second wall groove 12 while the second electrical contact member 72 is in contact with the second conductive wall member 10. The vaporizer side surface 44 comprises a second vaporizer protrusion 48. The fourth electrical contact member 42 is located on the second vaporizer protrusion 48. The second vaporizer protrusion 48 is positioned in the second wall groove 12 while the fourth electrical contact member 42 is in contact with the second conductive wall member 10.

The method of the FIGS. 1-10 comprises placing the electrical power device 70 and the vaporizer in the inner space 4 of the housing by sliding the first device protrusion 79 and the first vaporizer protrusion 47 through the first wall groove 11 and by sliding the second device protrusion 80 and the second vaporizer protrusion 48 through the second wall groove 12.

In an alternative embodiment of the electronic cigarette 1, the inner wall surface 5 comprises a first wall ridge 13. The first conductive wall member 9 is located on the first wall ridge 13. The device side surface 76 comprises a first device groove 81. The first electrical contact member 71 is located in the first device groove 81. The first wall ridge 13 is positioned in the first device groove 81 while the first electrical contact member 71 is in contact with the first conductive wall member 9. The vaporizer side surface 44 comprises a first vaporizer groove. The third electrical contact member 41 is located in the first vaporizer groove. The first wall ridge 13 is positioned in the first vaporizer groove while the third electrical contact member 41 is in contact with the first conductive wall member 9. The inner wall surface 5 comprises a second wall ridge 14. The second conductive wall member 10 is located on the second wall ridge 14. The device side surface 76 comprises a second device groove 82. The second electrical contact member 72 is located in the second device groove 82. The second wall ridge 14 is positioned in the second device groove 82 while the second electrical contact member 72 is in contact with the second conductive wall member 10. The vaporizer side surface 44 comprises a second vaporizer groove. The fourth electrical contact member 42 is located in the second vaporizer groove. The second wall ridge 14 is positioned in the second vaporizer groove while the fourth electrical contact member 42 is in contact with the second conductive wall member 10.

An example of the housing 2 and electrical power device 70 of said alternative embodiment is shown in the FIGS. 18 A and B. It will be clear that the vaporizer 40 has a form similar to the electrical power device 70.

The method for producing said alternative embodiment comprises placing the electrical power device 70 and the vaporizer 40 in the inner space 4 of the housing 2 by sliding the first device groove 81 and the first vaporizer groove along the first wall ridge 13, and by sliding the second device groove 82 and the second vaporizer groove along the second wall ridge 14.

The FIGS. 14-21 (A and B) schematically show a view in cross section of the housing 2 and the electrical power device 70 of different embodiments of the electronic cigarette 1 according to the invention.

The FIGS. 14 A and B show an electronic cigarette similar to the first embodiment shown in the FIGS. 1-11. In FIG. 14A, the first conductor 30 and the second conductor 33 are located in the first wall groove 11 and the second wall groove 12, respectively. The first wall groove 11 and the second wall groove 12 are located at opposite sides of the inner wall surface 5 of the housing 2. In FIG. 14B, the first electrical contact member 71 and the second electrical contact member 72 are located on the first device protrusion 79 and the second device protrusion 80, respectively. The first device protrusion 79 and the second device protrusion 80 are located at opposite sides of the device side surface 76. The profiles of the housing 2 and the electrical power device 70 are rotational symmetrical. It will be clear that the vaporizer 40 has as form similar to the electrical power device 70.

In the alternative embodiment shown in the FIGS. 15 A and B, the first wall groove 11 and the second wall groove 12 are located closer to each other. The first device protrusion 79 and the second device protrusion 80 are also located closer to each other. The cross sectional profiles of the housing 2 and the electrical power device 70 are rotational asymmetrical. This has the advantage that it limits the number of different orientations in which the electrical power device 70 can be placed in the inner space 4 of the housing 2. It will be clear that (as in the situation of first embodiment of the electronic cigarette 1) for fitting in the inner space 4 of the housing 2, the first vaporizer protrusion 47 and the second vaporizer protrusion 48 of the vaporizer 40 are positioned in a similar manner as the first device protrusion 79 and the second device protrusion 80 of the electrical power device 70.

In the alternative embodiment shown in the FIGS. 16 A and B, a third wall groove 21 with a third conductor 36 is provided. This third conductor 36 can for example be electrically connected to the cathode 74 of the electrical power device 70 without being attached to it. A fifth electrical contact member 86 is located on a third device protrusion 88 of the device side surface 76 of the electrical power device 70. The fifth electrical contact member 86 is in use placed against and in contact with the third conductor 36 without being attached to the third conductor 36. The third conductor 36 can for example be used for a continuous power supply to a memory 100 provided in the electronic cigarette 1.

In the alternative embodiment shown in the FIGS. 17 A and B, a fourth wall groove 22 with a fourth conductor 37 is provided. When a switch 20 is integrated in the electrical power device 70, said switch 20 can for example be electrically connected to the electronic memory 100 without being attached to it. The fourth conductor 37 can this way be used as a communication line between the switch 20 and the memory 100. A sixth electrical contact member 87 is located on a fourth device protrusion 89 of the device side surface 76 of the electrical power device 70. The sixth electrical contact member 87 is in use placed against and in contact with the fourth conductor 37 without being attached to the fourth conductor 37. This allows the memory 100 to for example register the number of times that the switch 20 has closed the electrical circuit 19. This way, the number of times that the user has sucked on the outlet 7 of the electronic cigarette 1 can be registered.

In the alternative embodiment shown in the FIGS. 18 A and B, the first wall groove 11 and the second wall groove 12 of FIG. 14A are replaced by a first wall ridge 13 and a second wall ridge 14, and the first device protrusion 79 and the second device protrusion 80 of FIG. 14B are replaced by a first device groove 81 and a second device groove 82.

In the alternative embodiment shown in the FIGS. 19 A and B, the first and second wall groove 11, 12 of FIG. 15A are replaced by a first and second wall ridge 13, 14, and the first and second device protrusion 79, 80 of FIG. 15B are replaced by a first and second device groove 81, 82.

In the alternative embodiment shown in the FIGS. 20 A and B, the first, second and third wall groove 11, 12, 21 of FIG. 16A are replaced by a first, second and third wall ridge 13, 14, 23, and the first, second and third device protrusion 79, 80, 88 of FIG. 16B are replaced by a first, second and third device groove 81, 82, 90.

In the alternative embodiment shown in the FIGS. 21 A and B, the first, second, third and fourth wall groove 11, 12, 21, 22 of FIG. 17A are replaced by a first, second, third and fourth wall ridge 13, 14, 23, 24, and the first, second, third and fourth device protrusion 79, 80, 88, 89 of FIG. 17B are replaced by a first, second, third and fourth device groove 81, 82, 90, 91.

Figure 22:
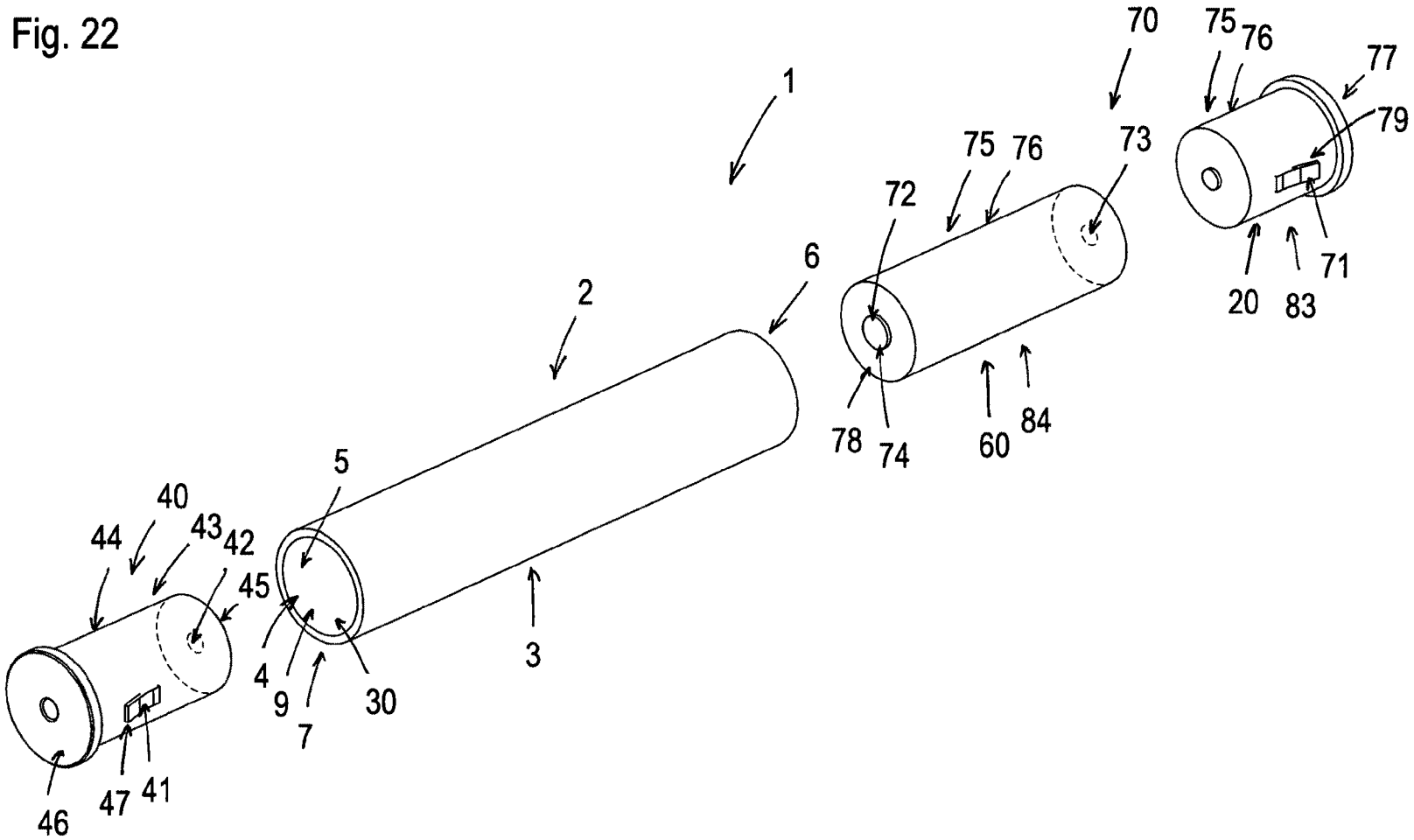
Figure 23:
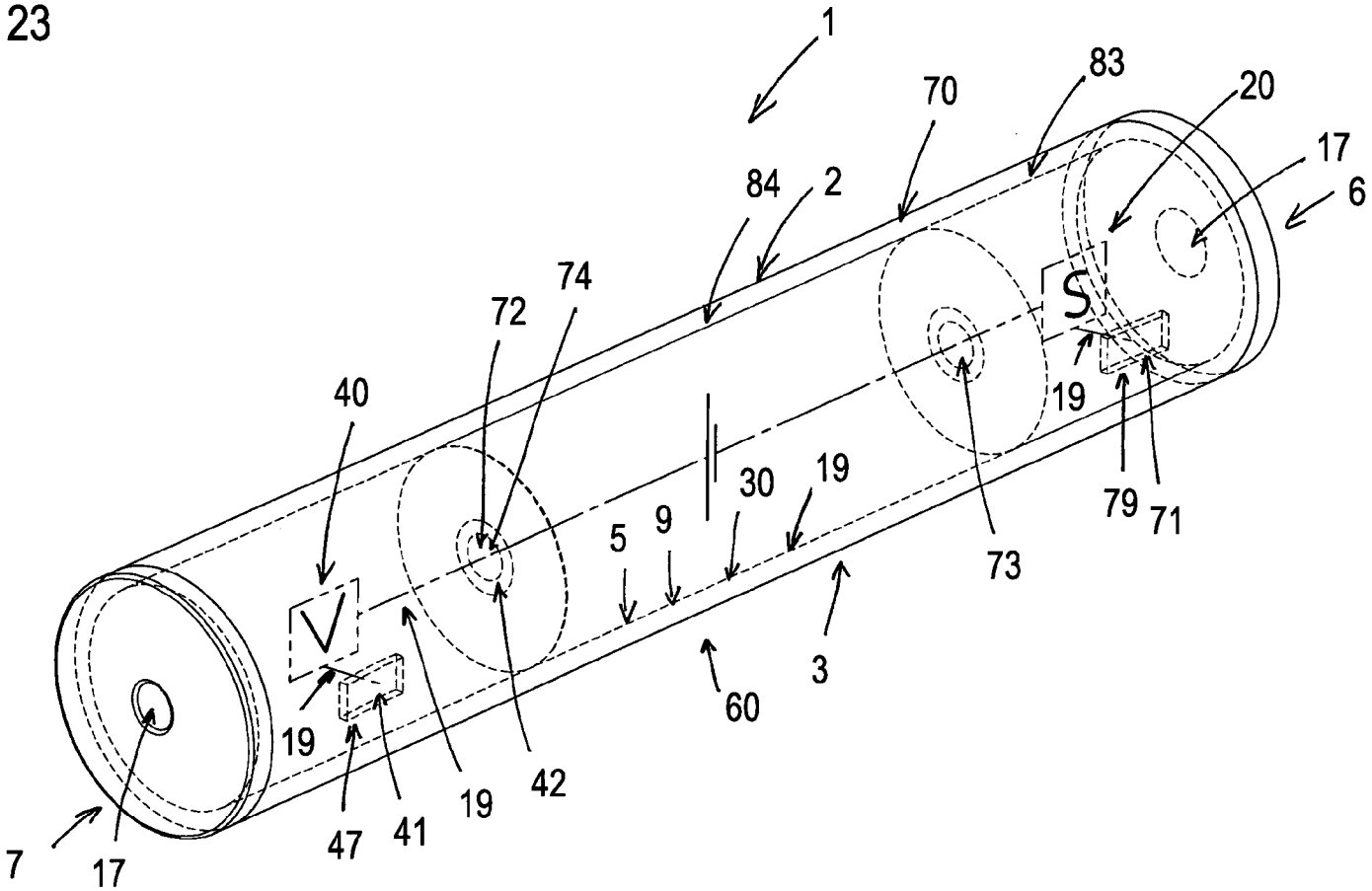

The FIGS. 22 and 23 show a view in perspective of a second embodiment of the electronic cigarette 1 and method according to the invention. FIG. 22 shows an exploded view of the electronic cigarette 1 and FIG. 23 shown the electronic cigarette 1 in an assembled state. Said second embodiment has feature C; the first electrical contact member 71 and the third electrical contact member 41 are both positioned against and in contact with a first conductor 30 without being attached to the first conductor 30, and the second electrical contact member 72 is positioned against and in contact with the fourth electrical contact member 42 without being attached to the fourth electrical contact member 42.

The first conductive wall member 9 is located on the inner wall surface 5. The device side surface 76 comprises a first device protrusion 79. The first electrical contact member 71 is located on the first device protrusion 79. The first device protrusion 79 is positioned against the inner wall surface 5 while the first electrical contact member 71 is in contact with the first conductive wall member 9. The vaporizer side surface 44 comprises a first vaporizer protrusion 47. The third electrical contact member 41 is located on the first vaporizer protrusion 47. The first vaporizer protrusion 47 is positioned against the inner wall surface 5 while the third electrical contact member 41 is in contact with the first conductive wall member 9. The first conductive wall member 9 fully surrounds the longitudinal housing axis 8.

Figure 24:
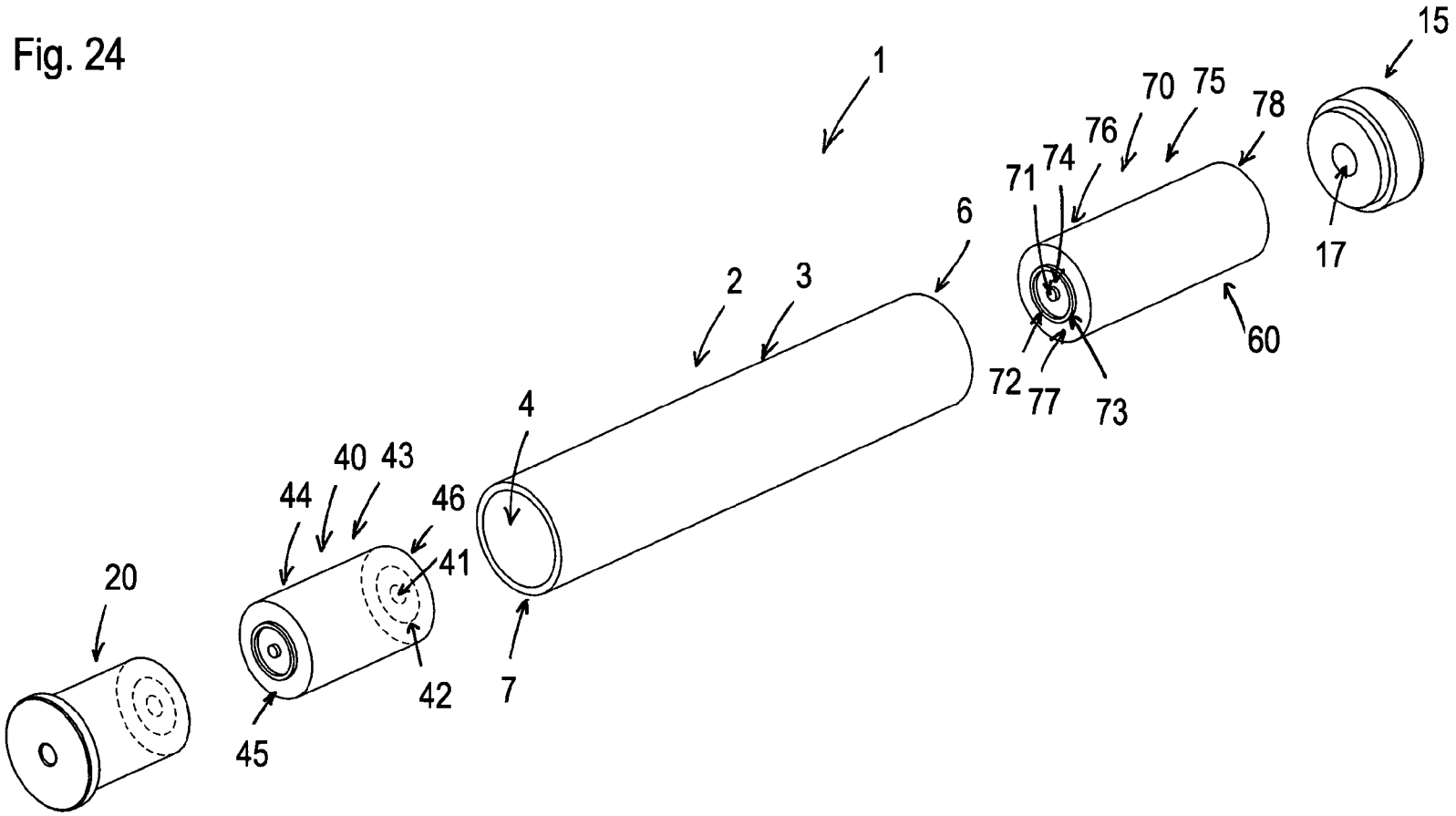
Figure 25:
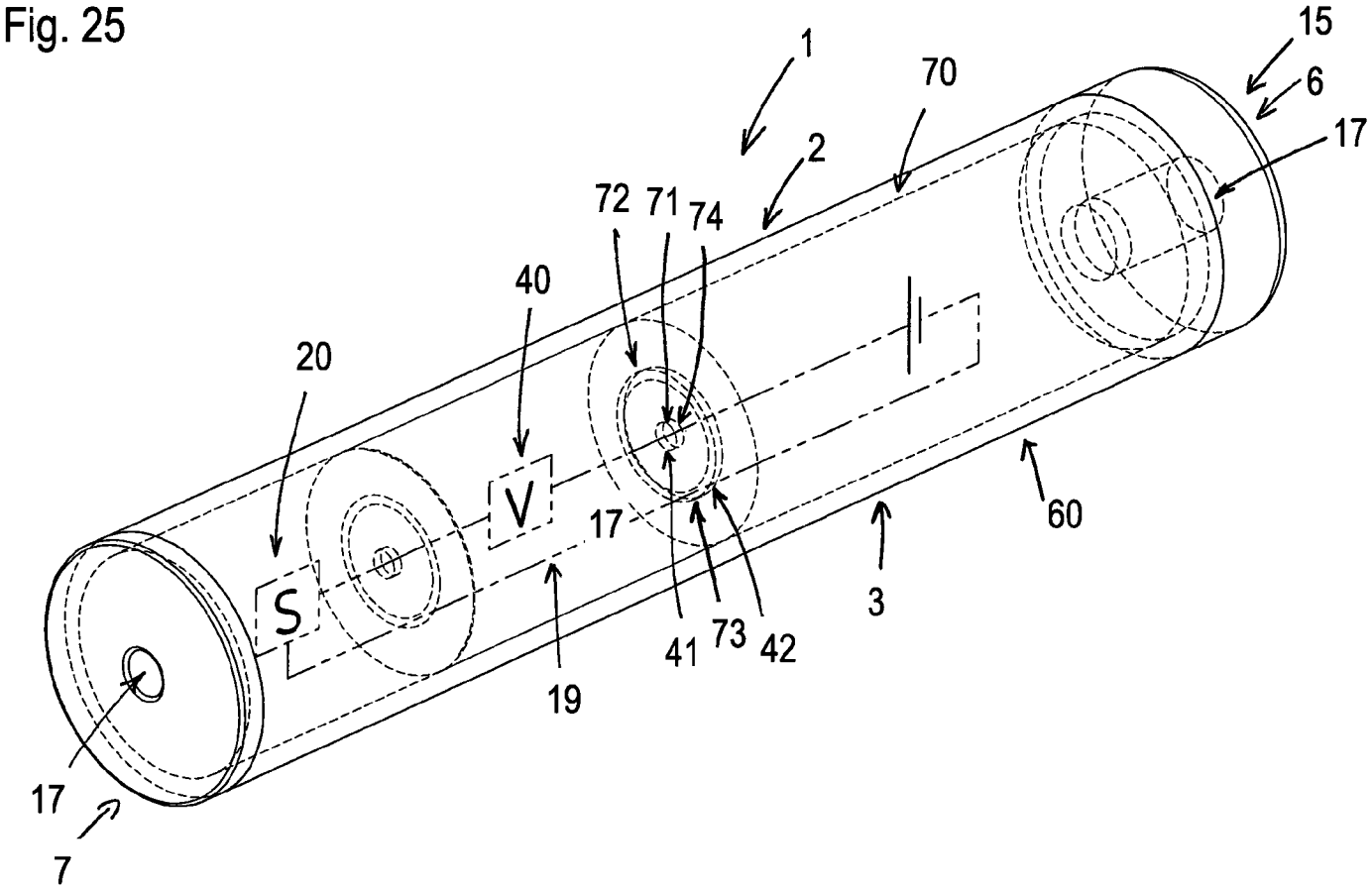

The FIGS. 24 and 25 show a view in perspective of a third embodiment of the electronic cigarette 1 and method according to the invention. FIG. 24 shows an exploded view of the electronic cigarette 1 and FIG. 25 shown the electronic cigarette 1 in an assembled state. Said third embodiment has feature A; the first electrical contact member 71 is positioned against and in contact with the third electrical contact member 41 without being attached to the third electrical contact member 41, and the second electrical contact member 72 is positioned against and in contact with the fourth electrical contact member 42 without being attached to the fourth electrical contact member 42.

The first electrical contact member 71 is located on the first device end surface 77 and the third electrical contact member 41 is located on the second vaporizer end surface 46. The second electrical contact member 72 is located on the first device end surface 77 and the fourth electrical contact member 42 is located on the second vaporizer end surface 46.

Figure 26:
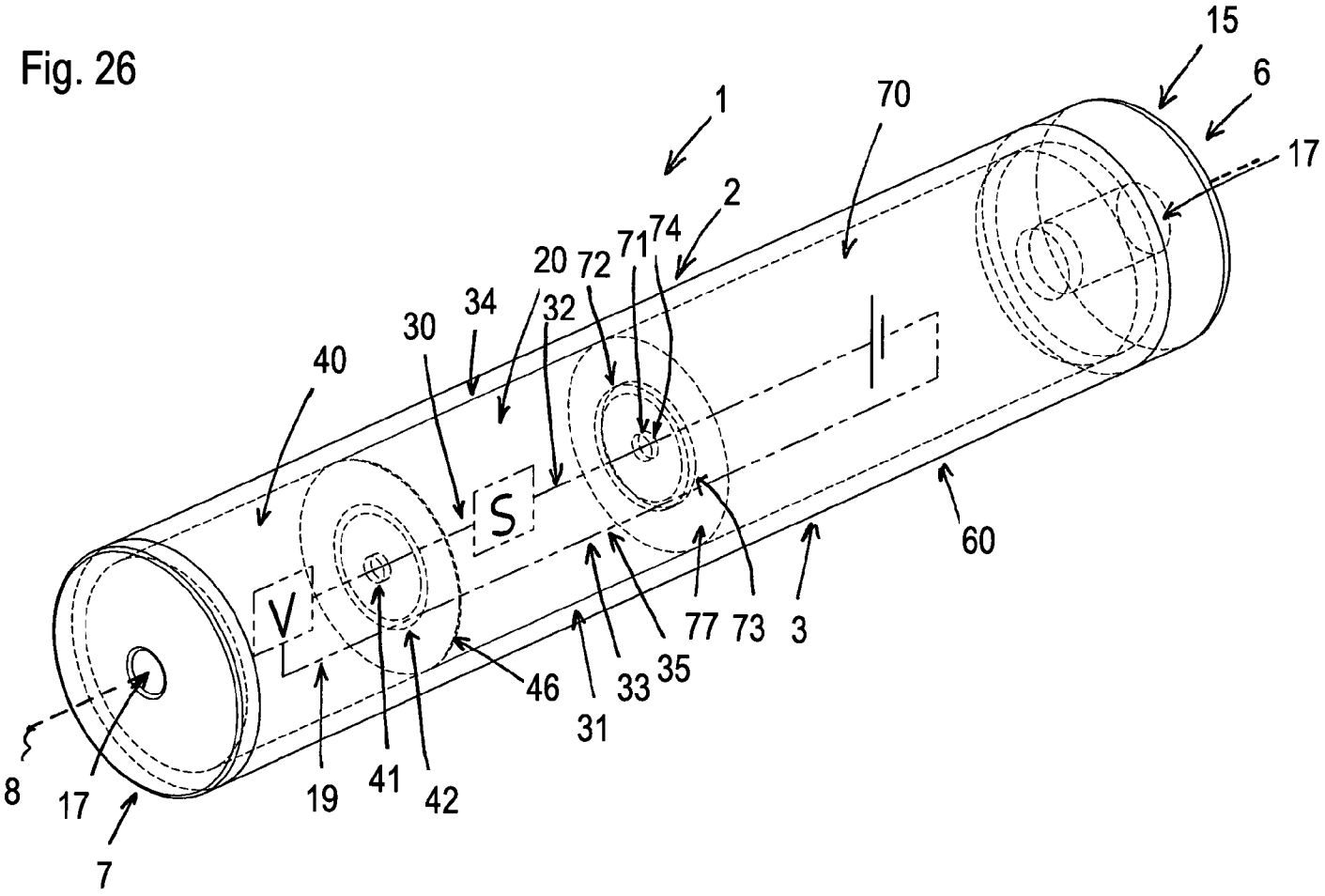

FIG. 26 shows a view in perspective of a fourth embodiment of the electronic cigarette 1 and method according to the invention. Said fourth embodiment has feature B; the first electrical contact member 71 and the third electrical contact member 41 are both positioned against and in contact with a first conductor 30 without being attached to the first conductor 30, and the second electrical contact member 72 and the fourth electrical contact member 42 are both positioned against and in contact with a second conductor 33 without being attached to the second conductor 33.

The first conductor 30 is, in the direction of the longitudinal housing axis 8, located between the first device end surface 77 and the second vaporizer end surface 46. The first conductor 30 is formed by a first conductive unit 31 which in the direction of the longitudinal housing axis 8 is located between the electrical power device 70 and the vaporizer 40 and comprises a first conductive unit member 32 being in contact with the first electrical contact member 71 and the third electrical contact member 41.

The second conductor 33 is, in the direction of the longitudinal housing axis 8, located between the first device end surface 77 and the second vaporizer end surface 46. The second conductor 33 is formed by a second conductive unit 34 which in the direction of the longitudinal housing axis 8 is located between the electrical power device 70 and the vaporizer and comprises a second conductive unit member 35 being in contact with the second electrical contact member 72 and the third electrical contact member 41.

The first conductive unit 31 and second conductive unit 34 are integrated in a single conductive unit. An automatic switch 20 is provided in the single conductive unit.

Figure 27:
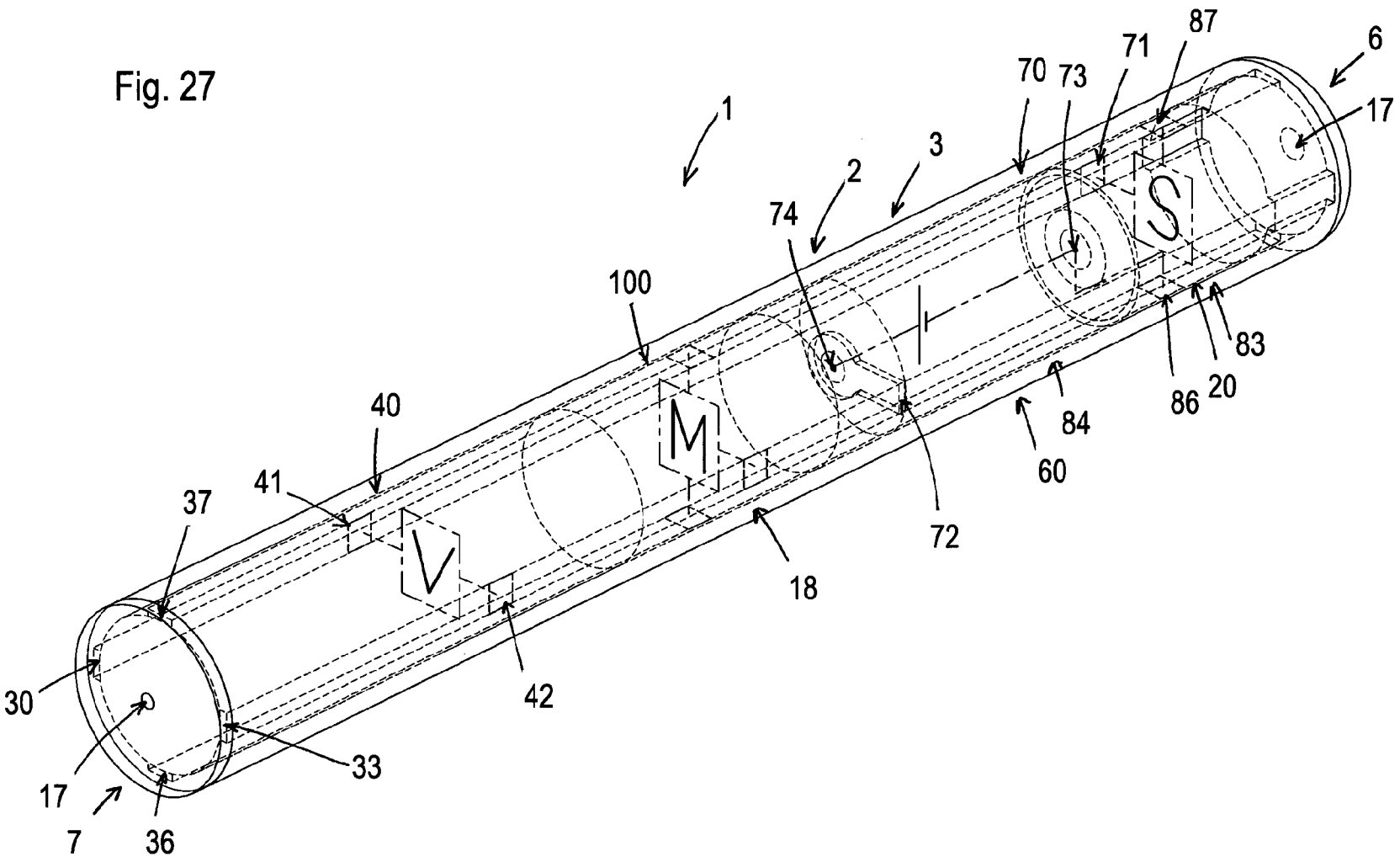

FIG. 27 shows a view in perspective of a fifth embodiment of the electronic cigarette 1 and method according to the invention. Said embodiment has feature B. The electronic cigarette 1 has an automatic switch 20 and a memory 100. In a similar manner as shown in FIGS. 17 A and B, the electronic cigarette 1 has a first conductor 30, a second conductor 33, a third conductor 36, and a fourth conductor 37. The switch 20 and memory 100 communicate with each other via the fourth conductor 37.

Figure 28:
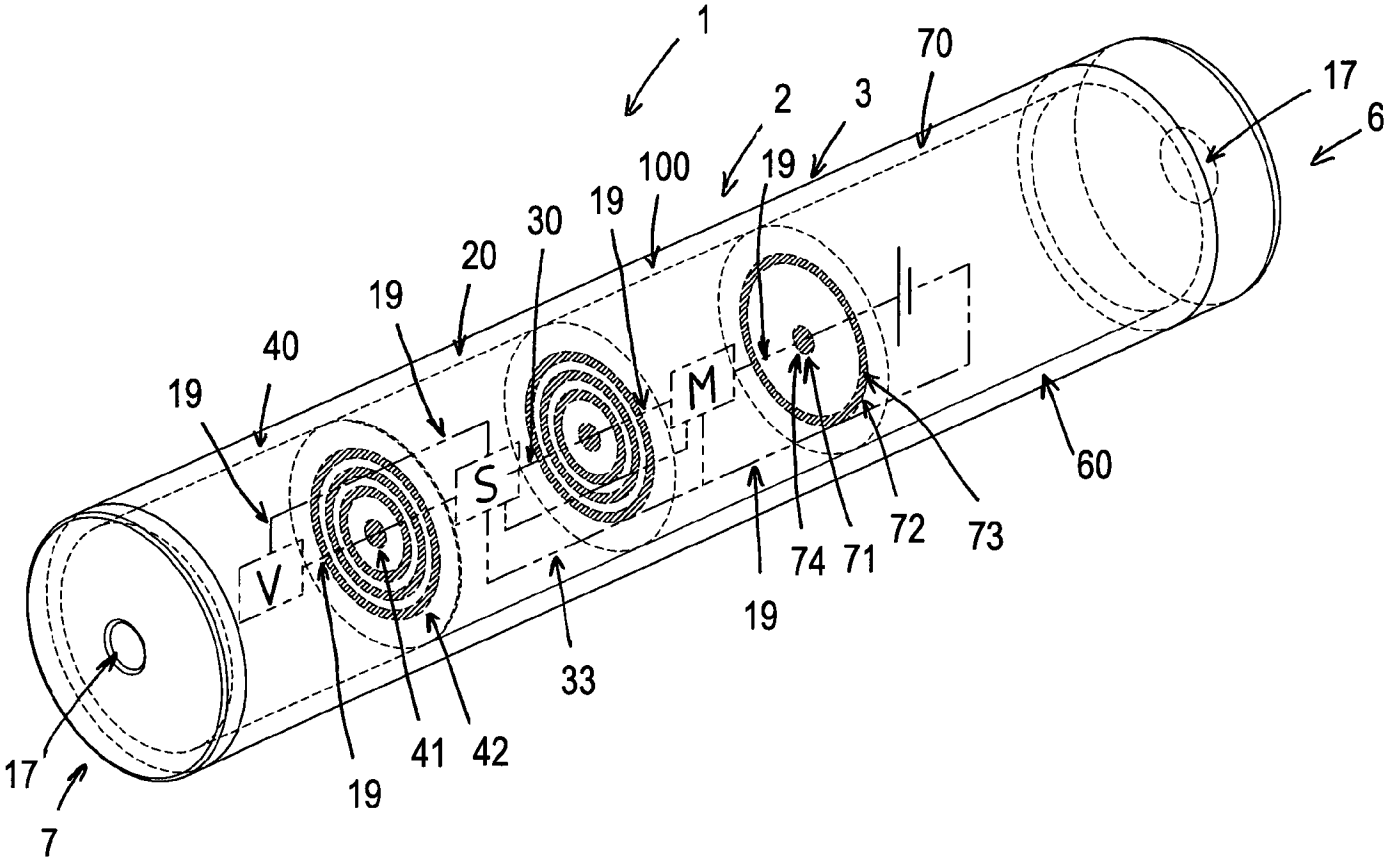
FIG. 28 shows a view in perspective of a sixth embodiment of the electronic cigarette and method according to the invention.

FIG. 28 shows a view in perspective of a sixth embodiment of the electronic cigarette 1 and method according to the invention. Said embodiment has feature B. The electronic cigarette 1 is also provided with an automatic switch 20 and a memory 100.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The terms including and/or having, as used herein, are defined as comprising (i.e., open language, not excluding other elements or steps). Any reference signs in the claims should not be construed as limiting the scope of the claims or the invention.

It will be apparent to those skilled in the art that various modifications can be made to the device and method without departing from the scope as defined in the claims.

The invention claimed is:

1. An electronic cigarette for providing a vapour, which electronic cigarette comprises;

a housing comprising a wall defining an inner space, and an inlet and an outlet providing access to the inner space, a vaporizer to produce the vapour and being located in the inner space of the housing, an electrical power device to provide electrical power to the vaporizer and being located in the inner space of the housing, wherein the electrical power device comprises a device outer surface, a first electrical contact member located on the device outer surface and being electrically connected to one of an anode and a cathode of the electrical power device, and a second electrical contact member located on the device outer surface and being electrically connected to the other of the anode and the cathode of the electrical power device, the device outer surface comprises a device side surface, a first device end surface, and an opposite second device end surface, the vaporizer comprises a vaporizer outer surface, a third electrical contact member located on the vaporizer outer surface, and a fourth electrical contact member located on the vaporizer outer surface, the vaporizer outer surface comprises a vaporizer side surface, a first vaporizer end surface, and an opposite second vaporizer end surface, the wall of the housing comprises an inner wall surface facing the inner space, and the electronic cigarette comprises one, and only one, of the following features B, and C;

B) the first electrical contact member and the third electrical contact member are both positioned against and in contact with a first conductor without being attached to the first conductor, and the second electrical contact member and the fourth electrical contact member are both positioned against and in contact with a second conductor without being attached to the second conductor, wherein the first electrical contact member is located on the device side surface, the third electrical contact member is located on the vaporizer side surface, and the first conductor is formed by a first conductive wall member located on the inner wall surface of the housing and being in contact with the first electrical contact member and the third electrical contact member, and wherein the second electrical contact member is located on the device side surface, the fourth electrical contact member is located on the vaporizer side surface, and the second conductor is formed by a second conductive wall member located on the inner wall surface of the housing being in contact with the second electrical contact member and the fourth electrical contact member, and C) the first electrical contact member and the third electrical contact member are both positioned against and in contact with a first conductor without being attached to the first conductor, and the second electrical contact member is positioned against and in contact with the fourth electrical contact member without being attached to the fourth electrical contact members wherein the first electrical contact member is located on the device side surface, the third electrical contact member is located on the vaporizer side surface, and the first conductor is formed by a first conductive wall member located on the inner wall surface of the housing and being in contact with the first electrical contact member and the third electrical contact member, and wherein the electrical power device and the vaporizer are dimensioned to be slided in the inner space of the housing via the inlet or the outlet.

2. The electronic cigarette according to claim 1, wherein the first conductor extends from the first electrical contact member to the third electrical contact member.

3. The electronic cigarette according to claim 1, wherein the second conductor extends from the second electrical contact member to the fourth electrical contact member.

4. The electronic cigarette according to claim 1, wherein;

the first conductive wall member is located on the inner wall surface, the device side surface comprises a first device protrusion, the first electrical contact member is located on the first device protrusion, the first device protrusion is positioned against the inner wall surface while the first electrical contact member is in contact with the first conductive wall member, the vaporizer side surface comprises a first vaporizer protrusion, the third electrical contact member is located on the first vaporizer protrusion, and the first vaporizer protrusion is positioned against the inner wall surface while the third electrical contact member is in contact with the first conductive wall member.

5. The electronic cigarette according to claim 1, wherein the housing comprises a longitudinal axis and the first conductive wall member fully surrounds the longitudinal housing axis.

6. The electronic cigarette according to claim 1, wherein;

the inner wall surface comprises a first wall groove, the first conductive wall member is located in the first wall groove, the device side surface comprises a first device protrusion, the first electrical contact member is located on the first device protrusion, the first device protrusion is positioned in the first wall groove while the first electrical contact member is in contact with the first conductive wall member, the vaporizer side surface comprises a first vaporizer protrusion, the third electrical contact member is located on the first vaporizer protrusion, and the first vaporizer protrusion is positioned in the first wall groove while the third electrical contact member is in contact with the first conductive wall member.

7. The electronic cigarette according to claim 1, wherein;
the inner wall surface comprises a second wall groove,
the second conductive wall member is located in the second wall groove,
the device side surface comprises a second device protrusion,
the second electrical contact member is located on the second device protrusion,
the second device protrusion is positioned in the second wall groove while the second electrical contact member is in contact with the second conductive wall member,
the vaporizer side surface comprises a second vaporizer protrusion,
the fourth electrical contact member is located on the second vaporizer protrusion, and
the second vaporizer protrusion is positioned in the second wall groove while the fourth electrical contact member is in contact with the second conductive wall member.

8. The electronic cigarette according to claim 1, wherein;
the inner wall surface comprises a first wall ridge,
the first conductive wall member is located on the first wall ridge,
the device side surface comprises a first device groove,
the first electrical contact member is located in the first device groove,
the first wall ridge is positioned in the first device groove while the first electrical contact member is in contact with the first conductive wall member,
the vaporizer side surface comprises a first vaporizer groove,
the third electrical contact member is located in the first vaporizer groove, and
the first wall ridge is positioned in the first vaporizer groove while the third electrical contact member is in contact with the first conductive wall member.

9. The electronic cigarette according to claim 1, wherein;
the inner wall surface comprises a second wall ridge,
the second conductive wall member is located on the second wall ridge,
the device side surface comprises a second device groove,
the second electrical contact member is located in the second device groove,
the second wall ridge is positioned in the second device groove while the second electrical contact member is in contact with the second conductive wall member,
the vaporizer side surface comprises a second vaporizer groove,
the fourth electrical contact member is located in the second vaporizer groove, and
the second wall ridge is positioned in the second vaporizer groove while the fourth electrical contact member is in contact with the second conductive wall member.

10. The electronic cigarette according to claim 1, wherein the first electrical contact member and the second electrical contact member of the electrical power device, and the third electrical contact member and fourth electrical contact member of the vaporizer form part of an electronic circuit of the electronic cigarette, and the electronic circuit also comprises a switch to open and close the electronic circuit.

11. The electronic cigarette according to claim 10, wherein the switch is an automatic switch configured to detect an airflow and to close the electronic circuit when an airflow is detected and to open the electronic circuit when no airflow is detected.

12. A method for producing an electronic cigarette comprising a housing, an electrical power device, and a vaporizer, which method comprises the steps of;
providing the housing comprising a wall which defines an inner space, and an inlet and an outlet providing access to the inner space, wherein the wall of the housing comprises an inner wall surface facing the inner space,
providing the electrical power device which comprises a device outer surface, a first electrical contact member located on the device outer surface and being electrically connected to one of an anode and a cathode of the electrical power device, and a second electrical contact member located on the device outer surface and being electrically connected to the other of the anode and the cathode of the electrical power device, wherein the device outer surface comprises a device side surface, a first device end surface, and an opposite second device end surface,
providing the vaporizer which comprises a vaporizer outer surface, a third electrical contact member located on the vaporizer outer surface and a fourth electrical contact member located on the vaporizer outer surface, wherein the vaporizer outer surface comprises a vaporizer side surface, a first vaporizer end surface, and an opposite second vaporizer end surface, and
the method comprises one, and only one, of the following steps B, and C;
B) placing the electrical power device and the vaporizer in the inner space of the housing, such that the first electrical contact member and the third electrical contact member are both positioned against and in contact with a first conductor without being attached to the first conductor, the second electrical contact member and the fourth electrical contact member are both positioned against and in contact with a second conductor without being attached to the second conductor, wherein the first electrical contact member is located on the device side surface, the third electrical contact member is located on the vaporizer side surface, the first conductor is formed by a first conductive wall member located on the inner wall surface of the housing, and the placing of the electrical power device and the vaporizer in the inner space of the housing comprises sliding the first electrical contact member and the third electrical contact member along the first conductive wall member, and wherein the second electrical contact member is located on the device side surface, the fourth electrical contact member is located on the vaporizer side surface, and the second conductor is formed by a second conductive wall member located on the inner wall surface of the housing, and the placing of the electrical power device and the vaporizer in the inner space of the housing comprises sliding the second electrical contact member and the fourth electrical contact member along the second conductive wall member, and
C) placing the electrical power device and the vaporizer in the inner space of the housing, such that the first electrical contact member and the third electrical contact member are both positioned against and in contact with a first conductor without being attached to the first conductor, and the second electrical contact member is positioned against and in contact with the fourth electrical contact member without being attached to the fourth electrical contact member, wherein the first electrical contact member is located on the device side surface, the third electrical contact member is located on the vaporizer side surface, the first conductor is formed by a first conductive wall member located on the inner wall surface of the housing and, and the placing of the electrical power device and the vaporizer in the inner space of the housing comprises sliding the first electrical contact member and the third electrical contact member along the first conductive wall member, wherein the placing of the electrical power device and the vaporizer in the inner space of the housing comprises sliding the electrical power device and the vaporizer into the inner space of the housing via the inlet or the outlet.

13. The method according to claim 12, wherein the placing of the electrical power device and the vaporizer in the inner space of the housing comprises sliding the first device protrusion and the first vaporizer protrusion along the first conductive wall member.

14. The method according to claim 12, wherein the placing of the electrical power device and the vaporizer in the inner space of the housing comprises sliding the first device protrusion and the first vaporizer protrusion through the first wall groove.

15. The method according to claim 12, wherein the placing of the electrical power device and the vaporizer in the inner space of the housing comprises sliding the second device protrusion and the second vaporizer protrusion through the second wall groove.

16. The method according to claim 12, wherein the placing of the electrical power device and the vaporizer in the inner space of the housing comprises sliding the first device groove and the first vaporizer groove along the first wall ridge.

17. The method according to claim 12, wherein the placing of the electrical power device and the vaporizer in the inner space of the housing comprises sliding the second device groove and the second vaporizer groove along the second wall ridge.

* * * * *